US007559360B2

(12) United States Patent
Hobgood

(10) Patent No.: US 7,559,360 B2
(45) Date of Patent: Jul. 14, 2009

(54) TONG POSITIONING AND ALIGNMENT DEVICE

(76) Inventor: John Paul Hobgood, 159 N. LaCarpe Cir., Houma, LA (US) 70360

( * ) Notice: Subject to any disclaimer, the term of this patent is extended or adjusted under 35 U.S.C. 154(b) by 246 days.

(21) Appl. No.: 11/530,812

(22) Filed: Sep. 11, 2006

(65) Prior Publication Data

US 2008/0011470 A1 Jan. 17, 2008

Related U.S. Application Data

(63) Continuation-in-part of application No. 10/807,708, filed on Mar. 24, 2004, now Pat. No. 7,104,316.

(51) Int. Cl.
*E21B 19/16* (2006.01)

(52) U.S. Cl. ..... 166/85.1; 166/77.51; 166/379

(58) Field of Classification Search ..... 166/85.1, 166/379, 77.51; 81/57.15, 57.33; 73/862.25; 414/22.51, 22.65, 733, 745.1

See application file for complete search history.

(56) References Cited

U.S. PATENT DOCUMENTS 3,840,128 A * 10/1974 Swoboda et al. ..... 414/728
4,274,778 A * 6/1981 Putnam et al. ..... 414/22.71
5,040,438 A * 8/1991 Rousseau ..... 81/57.35
6,715,569 B1 * 4/2004 Rogers ..... 175/85

* cited by examiner

*Primary Examiner*—Jennifer H Gay
*Assistant Examiner*—Daniel P Stephenson
(74) *Attorney, Agent, or Firm*—Jones, Walker, Waechter, Poitevent, Carrere & Denegre, L.L.P.

(57) ABSTRACT

An improved tong positioning apparatus which includes a base positionable on the rig floor; a hydraulic cylinder positioned on the base, having a first end engageable to a rear support member and a second end engageable to a pivotal moment arm; a forward shock attachment arm engaged at a first end to one of a plurality of attachment points on the moment arm, and a second end which attaches to a tong frame attachment point on the tong. The forward shock attachment arm includes a pair of shock absorbers engaged along its length to provide a smooth, non-jerking motion both vertically and horizontally in moving the power tong. The tong positioning apparatus is designed to be remotely operated by hydraulic, air, air over hydraulics, electronically, by a single operator.

20 Claims, 22 Drawing Sheets

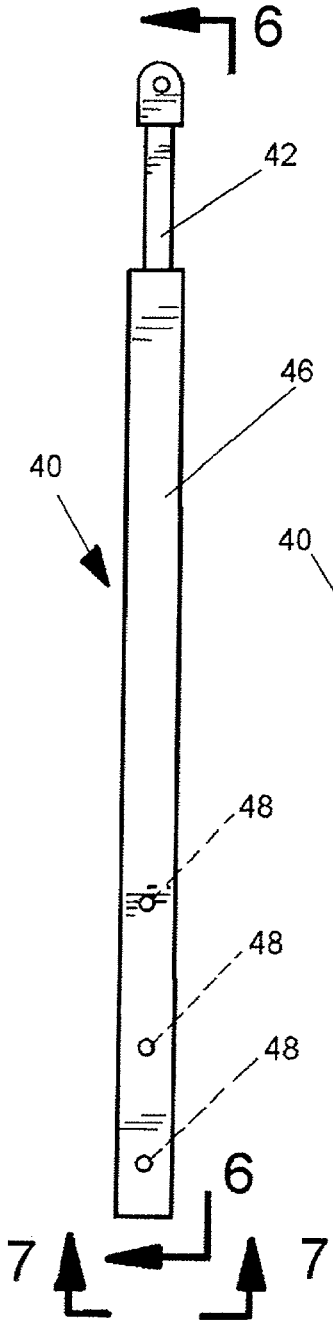
FIG. 5
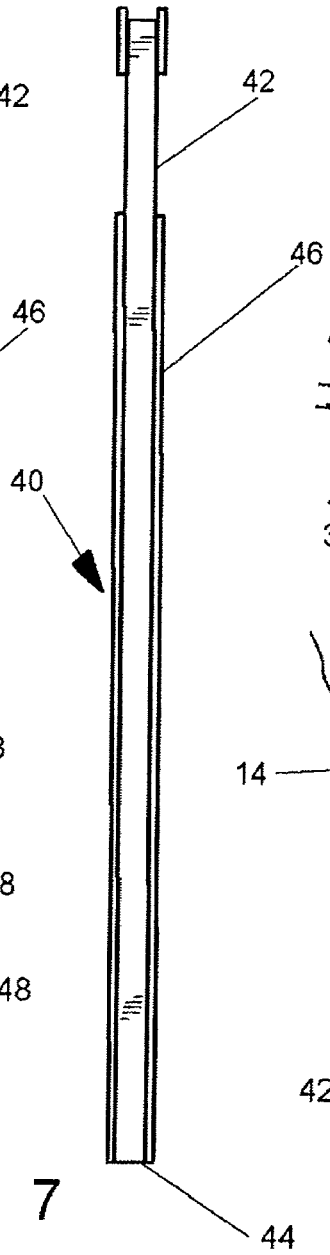
FIG. 6
FIG. 4
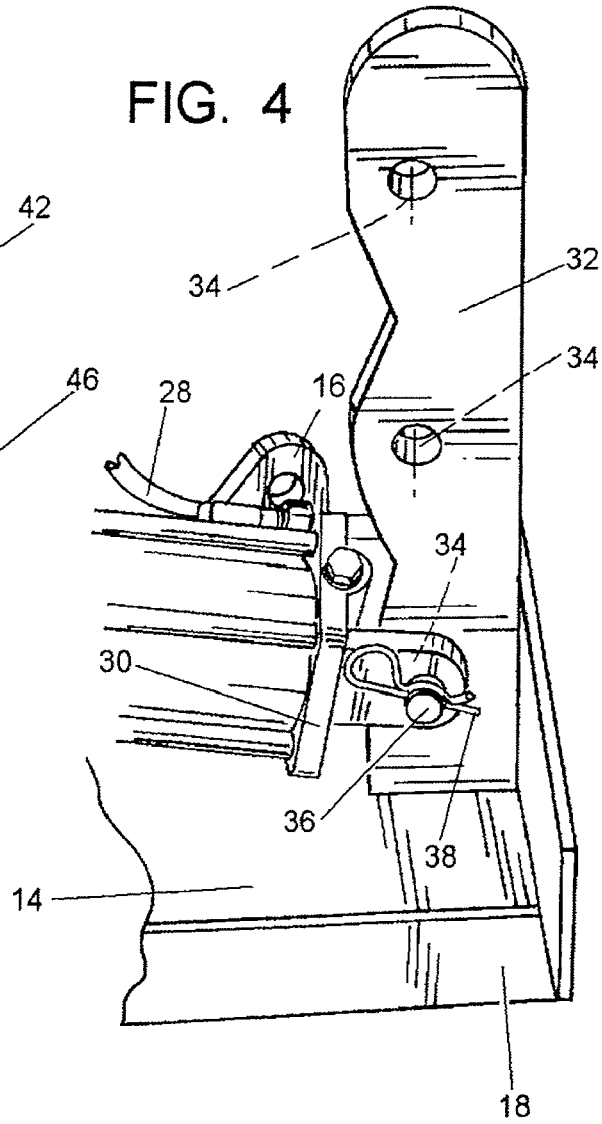
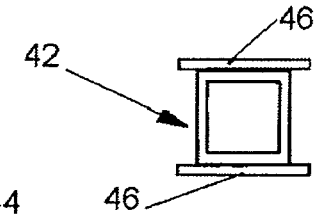
FIG. 7

TONG POSITIONING AND ALIGNMENT DEVICE

CROSS-REFERENCE TO RELATED APPLICATIONS

This is a continuation in part of prior patent application Ser. No. 10/807,708 filed Mar. 24, 2004 (now U.S. Pat. No. 7,104,316) which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Technical Field of the Invention

The present invention relates to oil field devices. More particularly, the present invention relates to an apparatus which has the ability to position and properly align a power tong around sections of oil field pipe on the rig floor by a single deck hand.

2. General Background of the Invention

In the drilling and completion phases in exploring for oil and gas, pipe tongs have been utilized for engaging lengths of drill or completion pipe, known generally as tubular members, end to end, by deck hands on the rig floor. A typical power tong comprises a first set of jaws which hold one section of pipe stationary while a second set of jaws rotate the next section to make up or break up the joint. The power tongs may weigh a few thousand pounds and are usually supported from the rig by a cable that allows the power tong to be moved manually by the deck hands to engage the pipe, or disengage from the pipe, and be positioned away from the pipe string, to allow other work to proceed. Interconnected by a hydraulic cylinder, often referred to as a 'lift' cylinder, the power tong is connected on the one end to the rig cable and to the other end there attached to the power tong. The hydraulic cylinder allows the Power Tong Operator, from the operator's position at the Power Tong, to make Vertical corrections, both upwardly and downwardly to the Power Tong for positioning on the make or break out of the pipe. Such a lift system is illustrated in FIG. 19, labeled "Prior Art" is well known in the art.

However, because of the size of the power tongs, more than a single individual, often times two or three men, are required to move the tong into position, and operate the tong to make up or break the joint, and then to manually swing the tong, hanging from the cable, out of the way, and engage it in a position away from the pipe, so that the deck hands can proceed to other chores. This manual operation of the tong in and out of position must be done with care, since the tong, swinging free from the cable, may strike one of the workers, or inadvertently disengage from its position and injure workers or damage materials on the rig floor. Typically there are two types or composition of pipe or tubulars screwed together one piece to another, end to end, until the entire number of sections of pipe required for the job are joined together and run into the ground below the rig floor. One composition of pipe is steel pipe which may be screwed together without much care taken by the deck hand and/or the type of handling tool and power tongs to be used. However, another composition of pipe utilized for this type work is Chrome 13 or similar soft composition which requires much care when screwing one pipe section to another section requiring the Power Tong to be carefully placed on each section to prevent damage to the external coating of each pipe section. As the Power Tong comes in contact with each Chrome pipe section, care must be taken not to have damaging contact which may result in rapid deterioration once exposed to a harsh environment down hole. The difficulty in operating power tongs in this fashion has led to attempts to provide a different system to utilize and maneuver power tongs on the rig floor.

For example, U.S. Pat. No. 6,318,214 entitled "Tong Positioning Apparatus," discloses a power tong support apparatus having a frame, and a base movably positioned on the frame, with the power tong support attached to the base and movable to and away from the power tong. However, one of the drawbacks to this device is that the device requires a rather large and cumbersome frame to support the tong support member, which is not desirable because of the scarcity of rig space. Further, the device does not appear to allow the tong support member to operate at variable heights from the rig floor, which is necessary, since the pipe sections may be connected and disconnected at various heights above the rig floor.

In addition to the patent cited above, applicant is submitting herewith an information disclosure statement which includes additional prior art that applicant is aware of at this time.

BRIEF SUMMARY OF THE INVENTION

The present invention solved the problems in the art in a simple and straight forward manner. What is provided is an improved tong positioning and alignment apparatus which includes a base with a drip pan, designed to capture accidental oil spill or drip from the system, positionable on the rig floor; a hydraulic cylinder positioned on the base, having a first end engageable to a rear support member and a second end engageable to a pivotal moment arm; a forward shock attachment arm(s) engaged at a first end to one of three attachment points on the moment arm, and a second end which attaches to a tong frame attachment point(s) on the tong. The (single) moment arm may be bilaterally functional provided the system has a pivotal shaft extending outwardly on each side of the forward support member whereby the forward end of the moment arm actually has two forward ends, one each on each side of the forward support member and each having multiple bores thus emanating the structure for an additional forward shock absorber attached thereof.

Further, the tong frame is designed with a forward tong frame pivotal attachment member to accommodate a forward shock absorber on each side which additionally provides greater strength and stability during the torque process and further limits the bending and shearing effect of the tong while in tension with the tubular section. The greater the stress established through the bending and shearing effect applied to the threaded connection, the greater the probability the torque turn graph may display a bad connection thus the potential to discard that particular threaded section. Each forward shock attachment arm includes a pair of shock absorbers engaged along its length to provide a smooth, non-jerking motion both vertically and horizontally in moving the power tong. Each forward shock attachment arm may also be designed with more than two shock absorbers or the use of only one single shock absorber is desirable if the handling procedure with the size and weight of each power tong thus dictates the need for such. The tong positioning apparatus is designed to be remotely operated by hydraulic, air, air over hydraulics, electronically, hard wired or wireless or otherwise by a single operator. There is further provided a plurality of attachment points on the rear support member, and a plurality of pivot points for the moment arm, to allow for various vertical and horizontal positioning of the tong during makeup and breakup of pipe on the rig floor. Further, the apparatus includes a safety shield system to insure the workers are protected from inadvertent contact with moving parts of the apparatus.

Further there is provided a means for aligning the pipe within the tong apparatus by so that pipe, such as Chrome 13, or similar soft pipe, can be carefully guided into the tong, and eased in position, without the pipe wall making forceful contact with the tong. There is further provided at least two cameras which view the entire operation so that the manipulation of the pipe can be accomplished by an operator from a remote location.

Therefore, it is a principal object of the present invention to provide an improved tong positioning and further to provide an alignment apparatus which insures a safe working environment and saves time, promotes efficiency and reduces fatigue while operating power tongs on a rig.

It is a further principal object of the present invention to provide a tong positioning and alignment apparatus which requires a minimum of rig space, is able to be operated by a single deck hand through a power system operated at the location of the power tong operations or remotely operated from any location on the rig floor.

It is a further object of the present invention to provide a tong positioning and alignment apparatus wherein a hydraulic cylinder or air cylinder, hydraulic motor, chain or belt drive, cam over action or otherwise any driver when activated, operates a moment arm, pivotally attached to a forward support member, which is attached through a shock absorbing member downward or otherwise vertically, upwardly or downwardly, or horizontally to a forward pivotal support member on the power tong frame to allow forward and rearward movement of the power tong at various heights above the rig floor.

It is a further object of the present invention to provide a tong positioning and alignment apparatus engineered to provide strength and stability to contain the predetermined rotational force of the tong and prevent potentially serious injury to any deck crew member should the snub line fail or be improperly adjusted. It is well known in the art that great torque is applied to the pipe by the upper tong jaws as the lower tong jaws hold the pipe in place. With such great torque applied to the pipe section presents the possibility of malfunction of the lower tong jaw which restrains the pipe while the upper tong jaw is making up the threaded connection to the desired torque value. Should the lower jaw fail and the upper tong continues its predetermined rotational path, the present invention is designed to contain and prevent said rotational path of the upper tong and further prevent possible serious injury or death to the rig crew members.

It is a further object of the present invention to provide a tong positioning and alignment system which includes a protective frame and cover which can be retracted in and out of position when necessary.

It is a further object of the present invention to provide a tong positioning device which incorporates a shock absorber system to allow the jaws of the device to contact soft pipe, such as chrome pipe, without damaging the wall of the pipe.

It is a further object of the present invention to provide a tong positioning and alignment device which incorporates a tubular guide plate on the tong but preferably attached on the hydraulic back-up, or lower tong, to allow the soft pipe, such as chrome pipe, to be gently guided into the open throat of the tong and further to the tong jaws without damaging the wall of the pipe.

It is a further object the present invention to provide a tong positioning and alignment device equipped with opposing intrinsically safe explosion proof video cameras in close proximity to the tubular guide plate and attached thereon. The video cameras are positioned to view each tubular section and further having a monitor mounted on the power tong visible to the tong operator and further a monitor located in the office of the rig supervisor to be utilized by the power tong operator and/or the rig supervisor as an aid to VHS or digitally record for later retrieval of said video for viewing and evaluation of (and store) the effect of the power tong positioner and alignment apparatus relative to the tubular guide plate in respect to the proper alignment of the upper jaw-die to each tubular section. In the event a problem is detected later in the completion phase, the VHS or digital recording is reviewed to determine if problems were associated with the tubular alignment and makeup procedure.

It is a further object of the present invention to provide a tong positioning device which requires minimum rig floor space, fewer personnel to work in a safer environment; makeup and break down pipe faster with less effort; and could be operated from a remote location on the rig floor.

It is a further object of the present invention to provide a power tong alignment system which is compact and easily attachable to the lower power tong and comprises the forward pipe section guide plate with pipe section/power tong alignment pads, two opposing intrinsically safe video cameras with view of the pipe section as the power tong is aligned and positioned on each pipe section, one on each side of the lower tong. Further, the power tong alignment system includes the tong door system which is operated by the power tong operator.

BRIEF DESCRIPTION OF THE DRAWINGS

For a further understanding of the nature, objects, and advantages of the present invention, reference is made to the following detailed description, read in conjunction with the following drawings, wherein like reference numerals denote like elements and wherein:

FIG. 4 illustrates an isolated view of the rear end of the hydraulic cylinder attached at one attachment point of the rear support member;

FIGS. 5 and 6 illustrate side and top views of the moment arm respectively;

FIG. 7 illustrates the moment arm in cross section view along lines 7-7 in FIG. 6;

DETAILED DESCRIPTION OF THE PREFERRED EMBODIMENTS

FIGS. 1 through 18 and 20 through 26 illustrate the preferred embodiment of the present invention; i.e., the improved tong positioning device (the "device") by the numeral 10. FIG. 19 illustrates a prior art lift system for a power tong, so that the operation of the present invention may be more fully explained.

Figure 1:
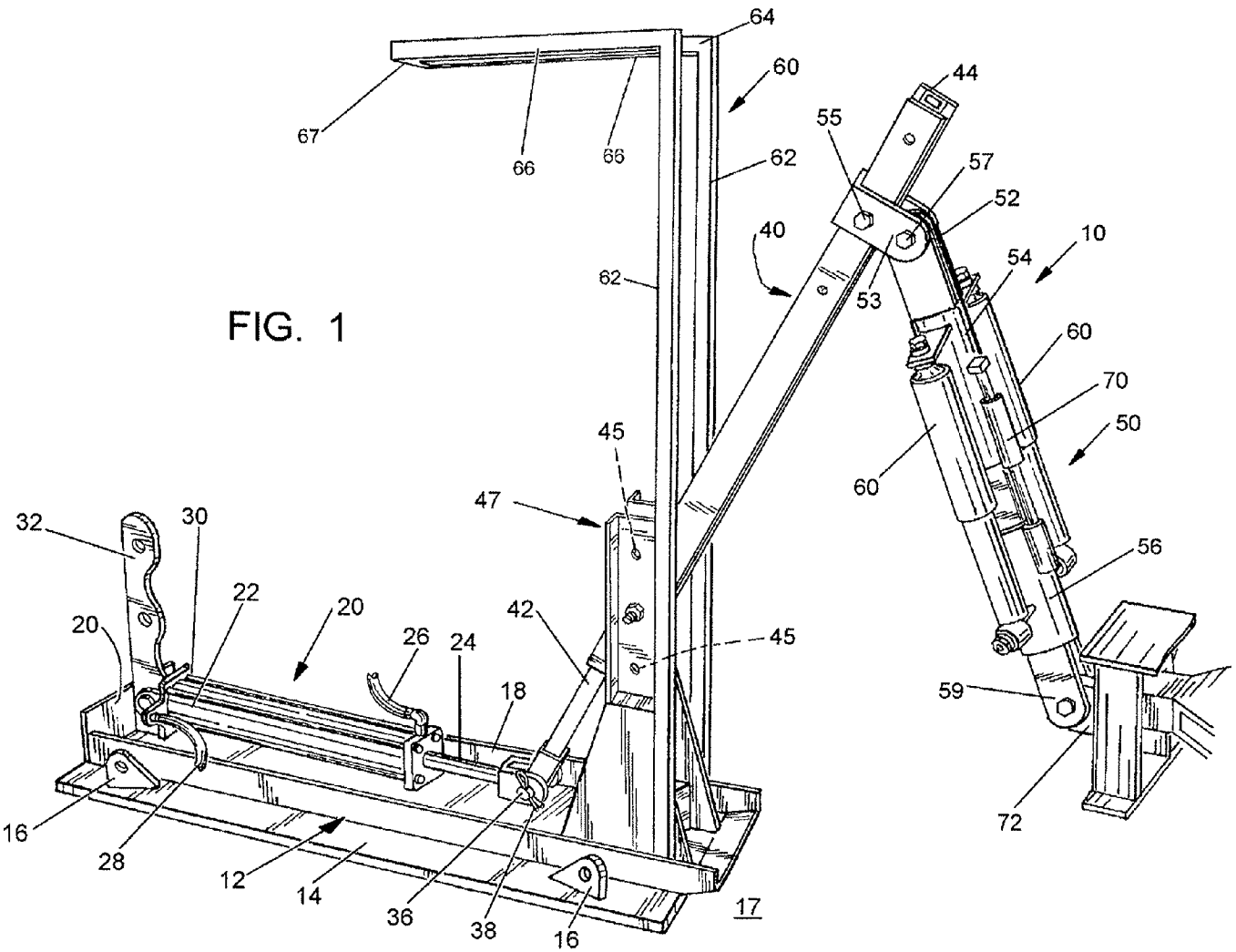
FIG. 1 illustrates an overall view of the preferred embodiment of the tong positioning system of the present invention.
Figure 2A:
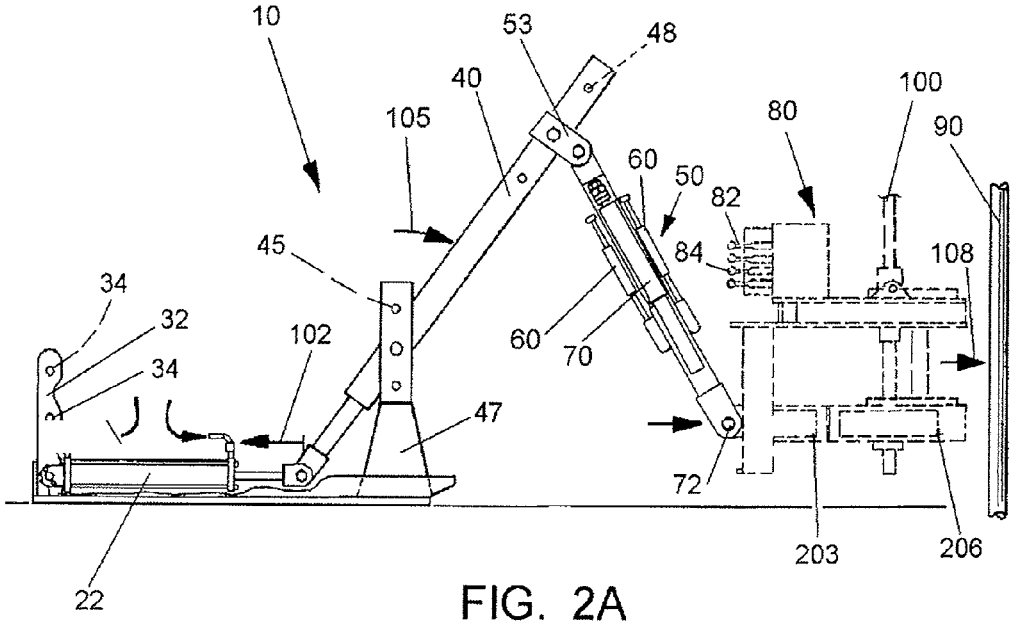
FIGS. 2A and 2B illustrate side views of the preferred embodiment of the tong positioning system of the present invention moving power tongs into and out of position relative to tubular members.
Figure 2B:
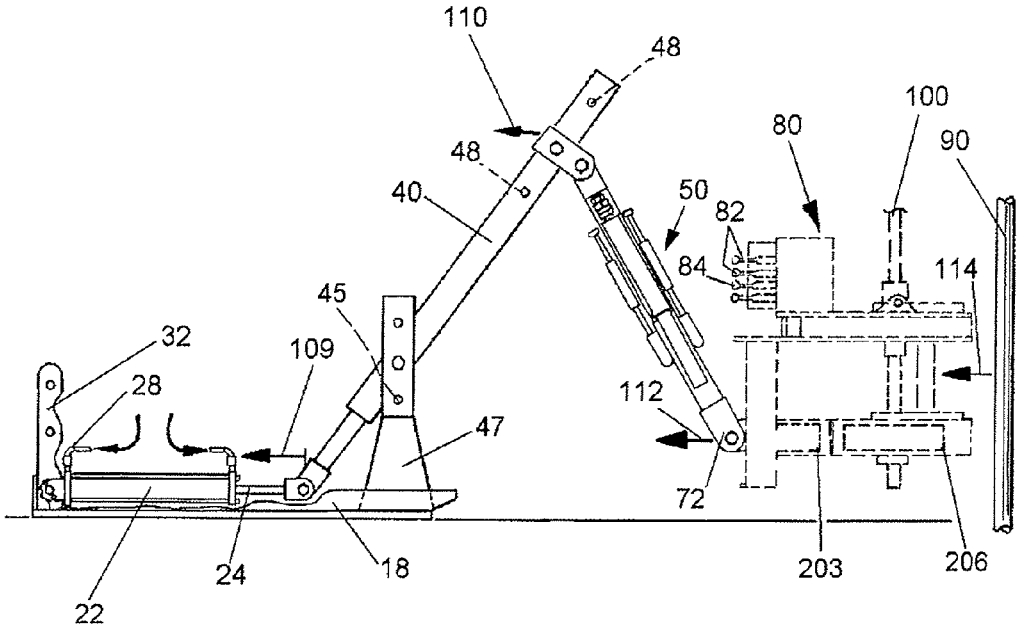
Figure 3:
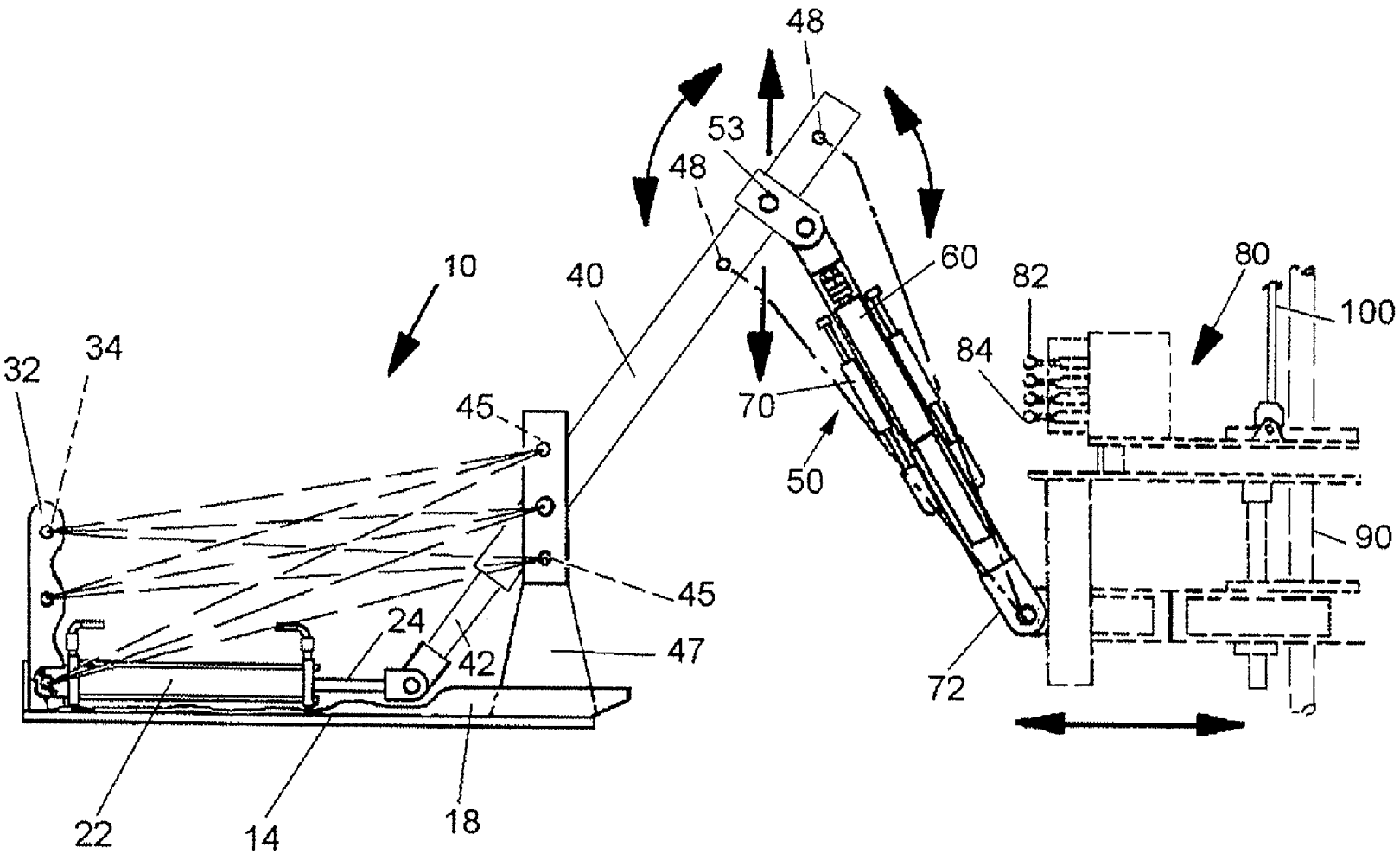
FIG. 3 illustrates a side view of the preferred embodiment of the tong positioning system of the present invention as it would be utilized in the plurality of positions on the rear support member, forward support member, and moment arm.

Turning first to the present invention, as illustrated in the various views, and in particular FIGS. 1 through 3, device 10 includes a base member 12 which comprises a flat base plate 14 of heavy iron or steel, having a lifting eye 16 at each corner for lifting device onto and off of a rig floor 17, and/or to aid in securing the device to the rig floor. There is further provided a rectangular container or box 18, having a plurality of walls 20, which would define a means for capturing any hydraulic or other type fluids which may be released from the device, and containing the fluids within the box 18, rather than the fluids flowing on the rig floor 17.

The rectangular container 18 would contain a power drive system 20, which as illustrated, comprises a hydraulic cylinder 22, having a piston member 24 moveable within the cylinder 22, driven by hydraulic fluid pumped through lines 26, 28, as is commonly known in the art. Although a hydraulic cylinder, containing hydraulic fluid is illustrated and discussed, it should be made clear that the scope of the power system may include diesel hydraulics, forced air pressure, electronic signaling between a sender and a receiver, or other similar systems, such as a belt or chain drive or cam over system. As illustrated, the first end 30 of the hydraulic cylinder 22 is secured to a vertical rear support member 32 which would be secured onto base plate 14 through welding or the like, as seen in isolated view in FIG. 4. The end 30 of the cylinder 22 is engaged into a first lower port 34, and held in place with a pin 36 and a cotter pin 38. There are two other ports 34 along the length of the rear support member 32, the purpose to be explained further. Likewise, returning to FIGS. 1 through 3, the piston 24 as engaged at its end to the lower end of a moment arm 40, in the same manner that the first end 30 of the cylinder 22 is engaged to the rear support member 32, i.e., a pin 36 and cotter pin 38.

The moment arm 40 is a very important part of the device 10, and is illustrated in isolated views in FIGS. 5 through 7. As illustrated the moment arm 40 includes an inner arm member 42 substantially square in cross section, and extending from its first connection point to the end of piston 24, as described earlier, to its upper end 44, where it terminates. There is further provided a pair of reinforcement plate members 46 secured along substantially the entire length of inner arm member 42, via welding or the like, except for a lower portion of the arm member 42, which engages the piston 24, as seen in FIG. 1. As seen in the Figures, there are provided a plurality of bores 48 near the upper end 44 of the moment arm 40, the bores 48, being bored through both the inner arm 42 and plate members 46 as illustrated. These bores will serve as alternate connection points between the moment arm 40 and the forward shock attachment arm 50, as will be discussed. Further, as a means to easily adapt the Moment arm 40 with the ability to extend the forward shock attachment arm 50 greater distances, an extension arm with a like plurality of bores 48 and corresponding adjustment length of each forward shock attachment arm 50 may be bolted to the upper end 44 of the moment arm 40. The moment arm also includes a bore 48 along its lower end when pivotally engaged to a forward upright support member 47, which, like the rear support member 32, is welded to the lower base plate 14. The support member 47 as illustrated, includes three bores 45 which would allow the moment arm 40 to pivot from one of the three bores 45 in support member 47 depending on work circumstances, as will be discussed.

As is seen further in FIGS. 1 through 3, the base 20 of the device also provides for a frame 60, which includes a pair of upright members 62, extending from the base plate 14, vertically, along the forward support member 47, to a height above the base 20, then extending at a right angle at point 64, to terminate in a pair of horizontal members 66, terminating at ends 67. The function of the frame 60 will be discussed further.

Figure 8:
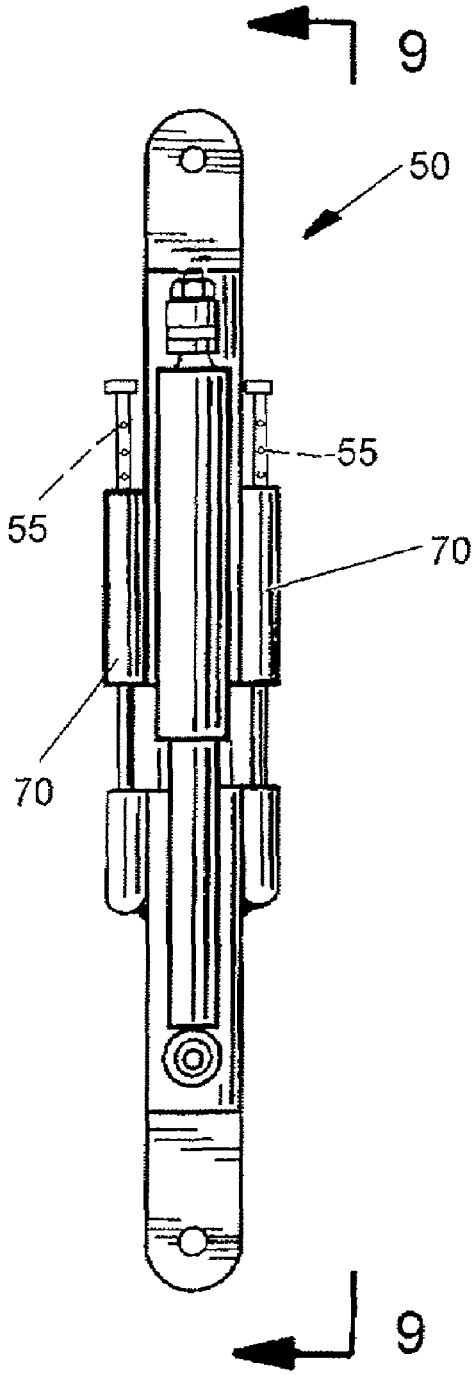
FIGS. 8 through 12 illustrate various views of the forward shock attachment arm during operation.
Figure 9:
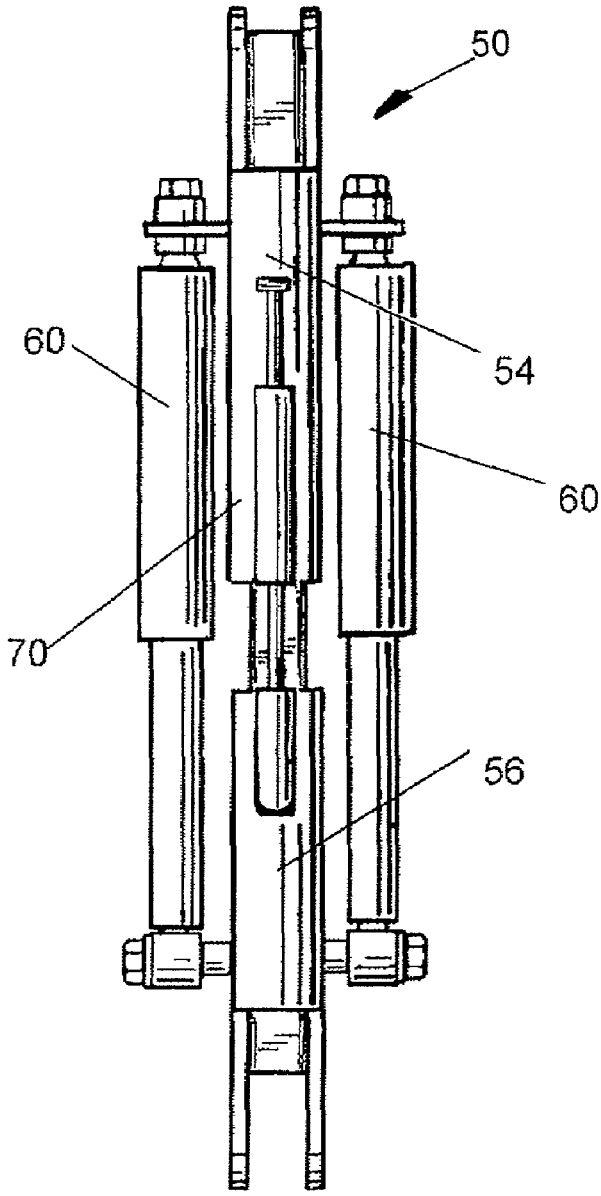
Figure 12:
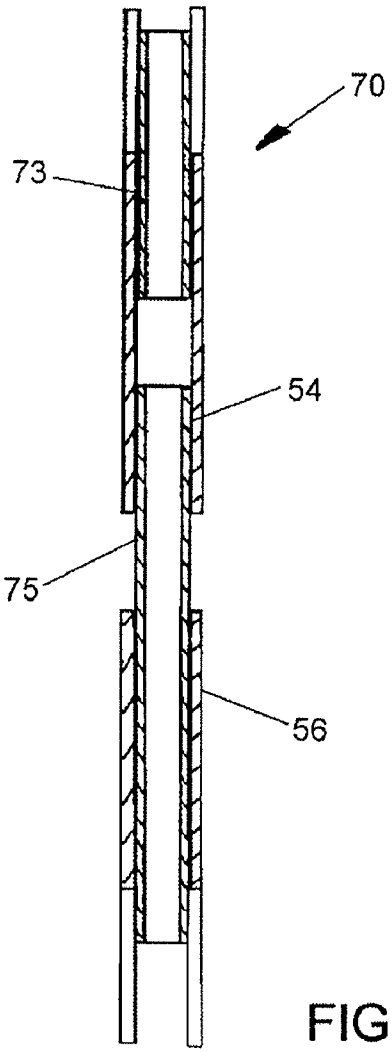
Figure 11:
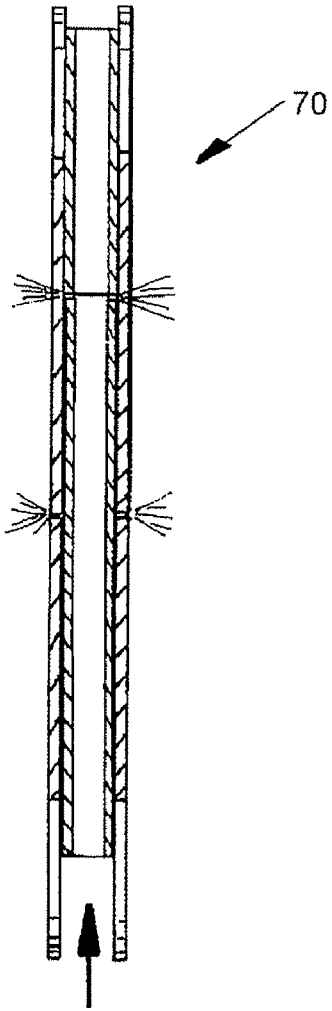
Figure 10:
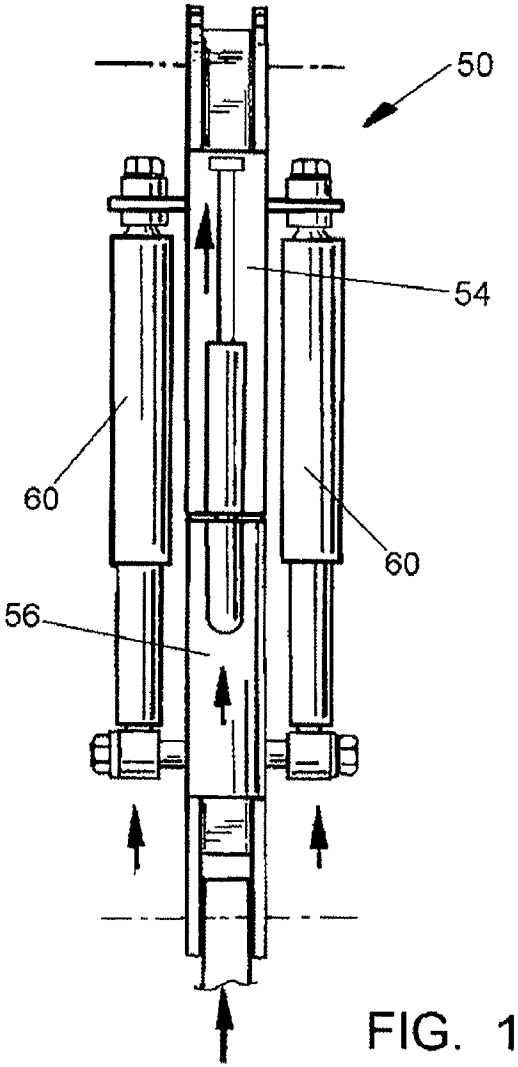

Returning to FIGS. 1 through 3, and making reference particularly to FIGS. 8 through 12, there is illustrated the forward shock attachment arm 50, which is engaged at a first end 52 to one of the bores 48 in the moment arm (in FIG. 1, connected at the mid bore 48), through the use of a unshaped connector member 53, having a first connection point to the moment arm 40 via bolt 55, and a second open-ended connection point to the end 52 of attachment arm 50 via bolt 57. This allows pivotal movement between the moment arm 40 and the attachment arm 50. The attachment arm 50 comprises first and second portions 54, 56 which are engaged to one another by a pair of air or gas cylinders 60, positioned on either side of he portions 54, 56, as illustrated. There is further illustrated a pair of external members 70 for limiting the expansion and contraction of the attachment arm 50 during its operation while said external members are further utilized as stabilizing guides to reduce any shearing, bending and/or rotational movement of the forward shock limiter and combines to further support the designed alignment procedure of the Power Tong in relation to the Tubular Section. Also known in the art is the great amount of torque applied to the pipe by the upper tong jaws as the lower tong jaws holds the pipe 90 in place. These members 70 span across to each portion 54, 56, and would allow for limited expansion and contraction of the two portions 54, 56, into and away from one another as the case may be. There are provided ports 55 in the members 70, as seen in FIG. 8, to preset the desired limit of expansion and contraction. The movement of the two portions 54, 56 are controlled by the air cylinders 60, which afford a precise movement, and limits or eliminates a sudden, jerking movement of the apparatus as it would be utilized to move the tong into position around a section of tubular member or away from the tubular members after make up or break down. FIGS. 11 and 12 illustrate the limits in which the movement of the two members 54 and 56 relative to one another during use of the device, by the inward and outward movement of the two sections 73, 75 of the limit members 70.

The second end 59 of the attachment arm 50 is pivotally engaged at point 72 to the tong support member 74, via a single bolt 76, which also allows pivotal movement between the attachment arm 50 and the power tong 80. One example of such an attachment method would be seen in FIG. 19 in this application. It should be made clear that although the power tong 80 is secured to the device 10 at attachment point 72 between the attachment arm 50 and the tong 80, the device is being used primarily, if not exclusively to position the tong 80 onto and off of a section of pipe 90. In this embodiment, it is not supporting the very heavy weight of the power tong 80. The tong 80, as seen in FIGS. 2A and 2B, is being supported by (a hydraulic cylinder known as a lift cylinder, of the type of prior art lift cylinder, illustrated in FIG. 19, interconnected at each end to a cable 100, as is currently known in the art.

So, in general, as seen in FIGS. 2A and 2B, an operator would stand adjacent tong 80, and have access to the various operation handles 82, which are used to open and close the tong jaws and spin the pipe, all functions already known. However, with this device, the operator has access to a second set of handles 84 which operate the cylinder 22, to commence operation of the device. As seen in FIG. 2A, the tong 80 is engaged to the forward attachment arm 50 at point 72, as the tong 80 is suspended from a device as shown in prior art FIG. 19, by cable 100, near pipe 90. The upper end of the arm 50 is engaged to the upper end of the moment arm 40 at point 57, which allows pivotal movement between the two. The moment arm 50 is pivotally engaged along the middle opening 45 of the upper support member 47, with its lower end engaged to the piston 24 of the cylinder 22. In FIG. 2A, when the operator manipulates the hydraulic fluid to force the piston 24 rearward into cylinder 22 (arrow 102), the moment arm 40 is pivoted in the direction of arrow 105. When this occurs, the lower end 59 of the attachment arm 50 is forced in the direction of arrow 106, when begins to provide forward movement of the tong 80 in the direction of the pipe 90, arrow 108. Because of the construction of the attachment arm 50, including the cylinders 60, the movement of the tong 80 would be smooth, and when the tong jaws would make contact with the wall of the pipe 90, the contact would be cushioned and would not damage the pipe wall. This is particularly important when brass or other soft metal, such as chrome tubular members are being used in the operation. Of course, when the device 10 has engaged the tong 80 on the pipe, and the operation is complete, the operator would activate the hydraulic fluid to flow to the rear of the piston 24, through line 28. The piston 22 would be forced out from cylinder 22, arrow 109, and in doing so, would pivot the upper end 44 of the moment arm 40 in the direction of arrow 110, which would pull the lower end 59 of the attachment arm 50 in the direction of arrow 112, and in turn moving the tong 80 away from the pipe 90, in direction of arrow 114. This operation would allow smooth movement of the tong 80 to engage and disengage from the pipe 90.

One particular feature not yet discussed in the operation and construction of the device 10 is its ability to effect different vertical and horizontal movements between the moment arm 40, attachment arm 50 and the tong 80, based upon the relative position of the tong 80 on the rig floor, which may also function when utilized in conjunction with the hydraulic lift cylinder interconnected between the rig cable and the tong. This ability is illustrated in FIG. 3 and FIG. 19, Prior Art). As was discussed earlier, rear support member 32 included a plurality of bores 34 to which the rear end 30 of the cylinder 22 could engage. Likewise, the forward upright support member 47 included a plurality of bores 45 in which the moment arm 40 could pivot along its path. Further, the upper end 44 of the moment arm 40 included a plurality of bores 48 in which the end of the attachment arm 50 could engage. The function of these various attachment choices between the cylinder 22, moment arm 40 and attachment arm 50 is illustrated in FIG. 3. As seen, for example, when the cylinder is attached to the upper most bore 34 of the rear plate 32, the angle and distance of the movement of the piston 24 would be changed, which would effect the movement of the moment arm 40 relative to the movement of the attachment arm 50. Since there are three different attachment points on the rear plate 32, three different attachment points for the moment arm 40 on the forward plate 47, and three different attachment points between the end 44 of the moment arm 40 and the attachment arm 50, the various combination of the attachment points would modify the travel of the cylinder/moment arm/attachment arm combination relative to the movement of the tong 80. The overall effect would be the ability of the attachment arm 50 to engage the tong 80 at differing heights above the rig floor 17, without having to position the base 12 of the apparatus 10 at different heights on the rig floor. The combination of attachment points would compensate for these variations, which could be determined at each job.

Figure 13:
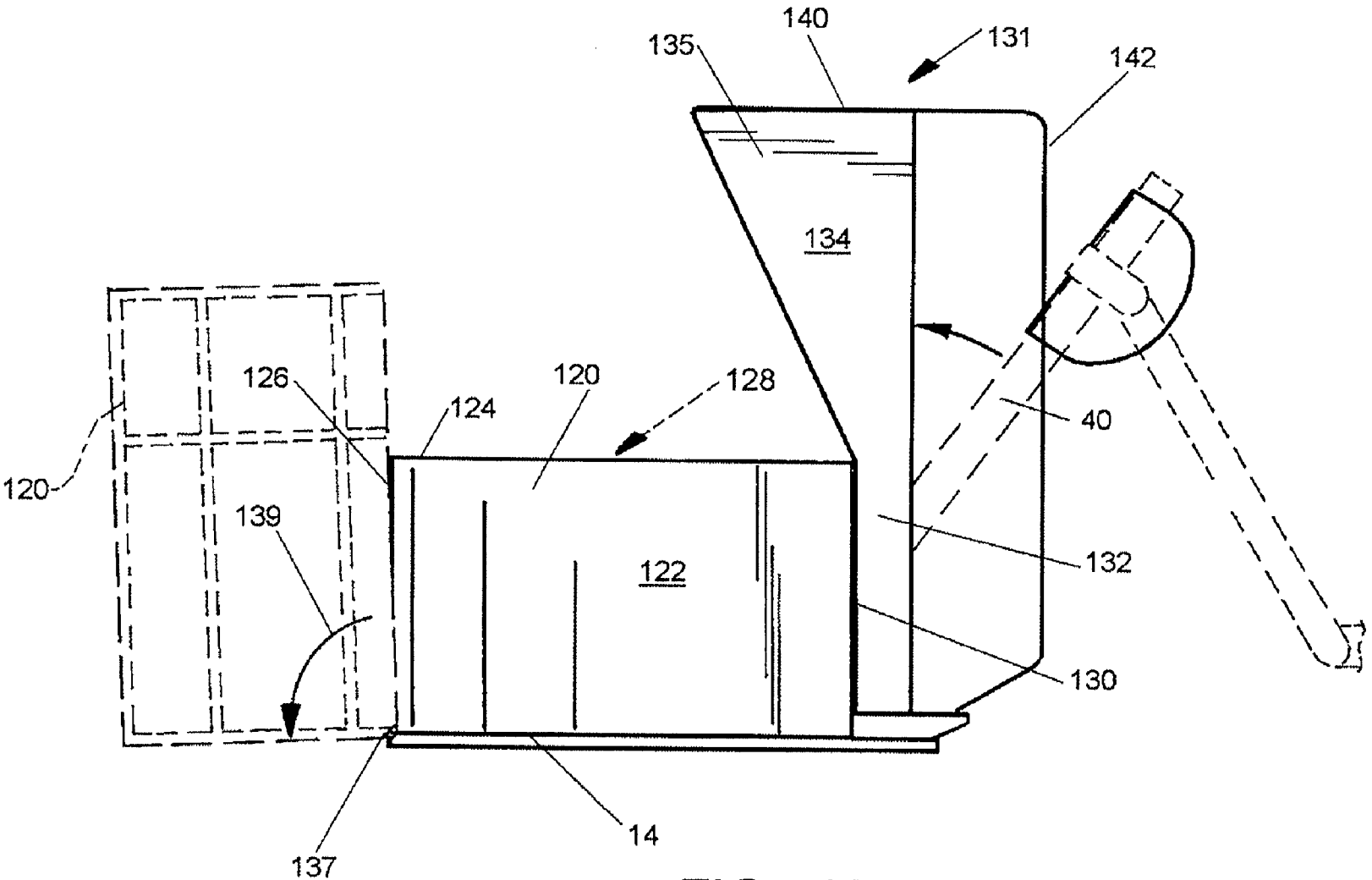
FIG. 13 illustrates a side view of the Frame and Cover system as it protects workers when utilizing the present invention.
Figure 14:
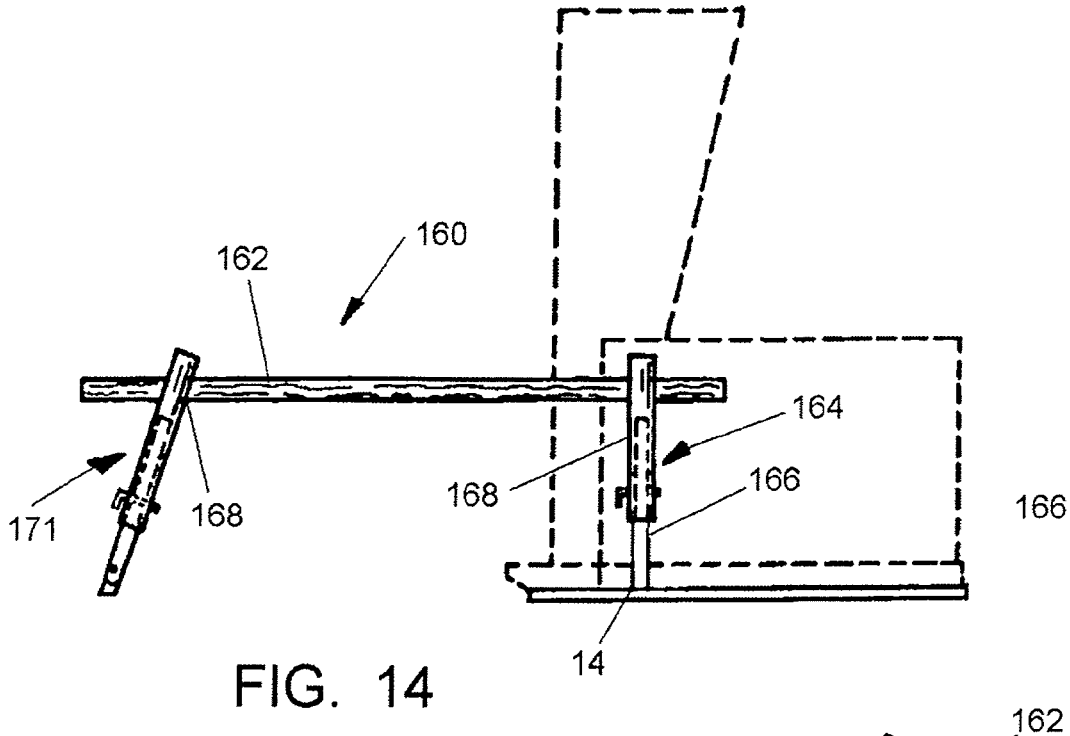
FIGS. 14 and 15 illustrate views of scaffolding which would be utilized when the invention is used in dual completion jobs, or otherwise any job running pipe into the hole whereby the threaded connection or makeup may not be positioned at the ideal makeup elevation in relation to the rig floor.
Figure 15:
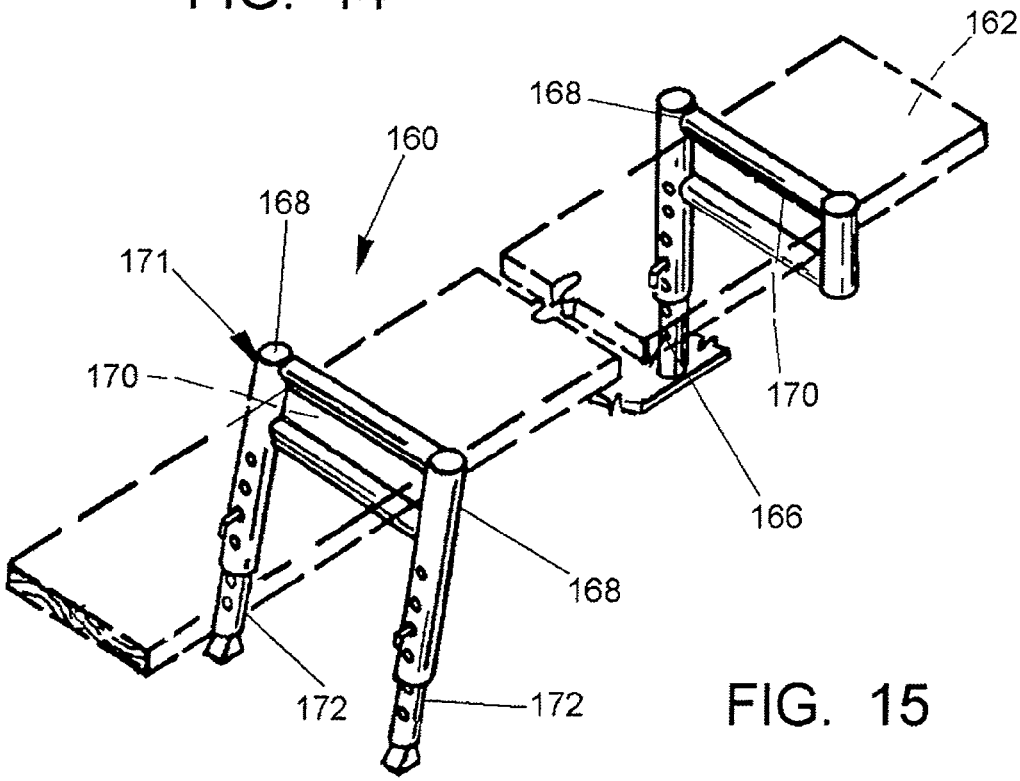

One important feature of the present invention, is because of its narrow profile; i.e., being no wider than the base upon which it rests, the apparatus 10 is able to be fully contained within a frame and cover as seen in FIGS. 13 through 15. As seen in overall side view in FIG. 13, the frame and cover would comprise two principal components. There would be provided a generally rectangular box portion 120 which would rest upon the lower base plate 14, and include a pair of sidewalls 122, an upper wall 124, and a rear wall 126, the walls defining an interior space 128 which, when the portion 120 is in position, as seen in FIG. 13, would completely cover the rear support member 32, the cylinder 22, piston 24 and the forward support member 47 and the container 18 which would house these members. Since the piston is engaged to the moment arm 40, the front face 130 of portion 120 would remain open, so as not to interfere with the connection between the piston 22 and moment arm 40.

Earlier, reference was made to the upright frame 60. This frame 60, as seen in FIG. 1, would allow a second component 131 of the cover to be set in place. This component 131 is illustrated in FIG. 13, also. It comprises an upright portion 132 which would have side walls 134, and a lower and truncated end wall 136 and would slide around the forward support member 47, and extend upward to a flared upper portion 138 which would be held in place by frame 60, discussed earlier. As seen in FIG. 13, the upper portion 138 includes the side walls 134, and a top portion 140; however, the forward face 142 of the component 130 would be left open. The reason for this is that even with the covers 120 and 130 in place, the device would still be allowed to operate, as seen in FIG. 13, with the moment arm 40 and attachment arm 50 seen in phantom view, as they would extend out from the opening in the face 142 of portion. When in this position, the operator would be protected from any inadvertent contact between the components which are under the covers 120, 130, which would greatly reduce the possibility of injury. Likewise, when not in use, the moment arm could be retracted to the vertical position within container 130, and the attachment arm would likewise fall to a complete vertical position, and would be shielded by the extended side walls 132 of the component 130, within the confines of the housing cover 130. There would be provided a semicircular plate 135 which would serve to shield a worker from contact with the connection point between the arms during operation.

Again, referencing FIG. 13, when accessing the interior of the housing 120, the housing 120 is hinged at point 137 along its rear end, so that the housing 120 could simply be rotated back in the direction of arrow 136, and the entire base components would be accessible.

FIGS. 14 and 15 illustrate views of scaffolding 160 which includes a scaffold board 162, usually a minimum of 12 inches in width, which is inserted into a first frame 164, having a single swivel leg 166, which allows the scaffold to be safely and temporarily secured out of the immediate work area of the well bore when not needed, secured to the base plate 14. The frame 164 would include a support frame 168, having an opening 170 for inserting the board 162 therethrough. The second end of the board would be inserted into a second frame 171, which would include a pair of legs 172, a support frame 170, and an opening 174 for inserting the board 162 therethrough. The second frame 171 would allow to tilt at an angle so as to engage the board 162 securely in place while the operators are standing thereupon to operate the upper tong in a casing running mode, the dual or multiple string completion operation. As illustrated, the frames 164 and 170 are height adjustable.

Figure 18:
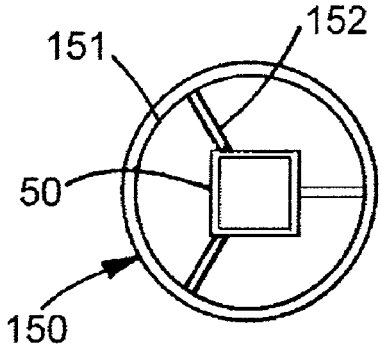
FIGS. 16 through 18 illustrate a protective cover for the forward shock attachment arm assembly.
Figure 16:
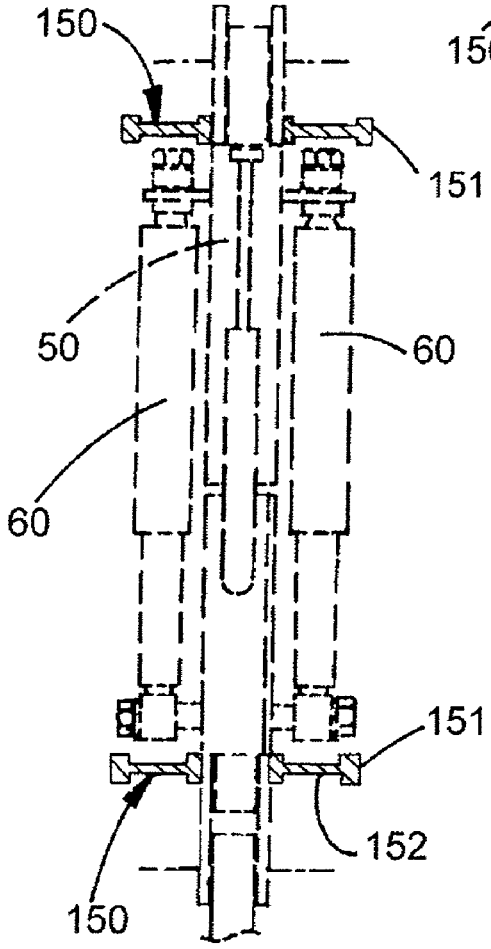
Figure 17:
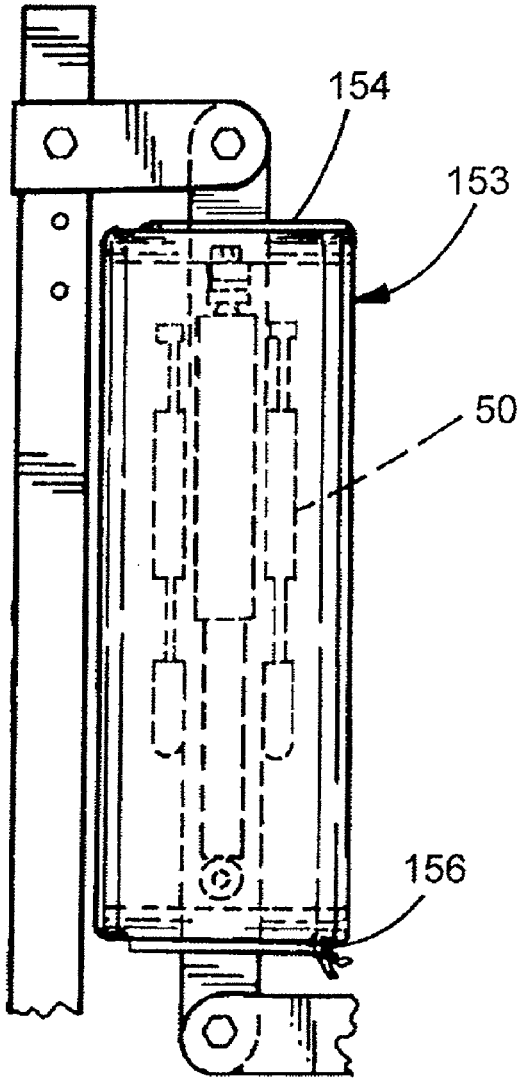
Figure 19:
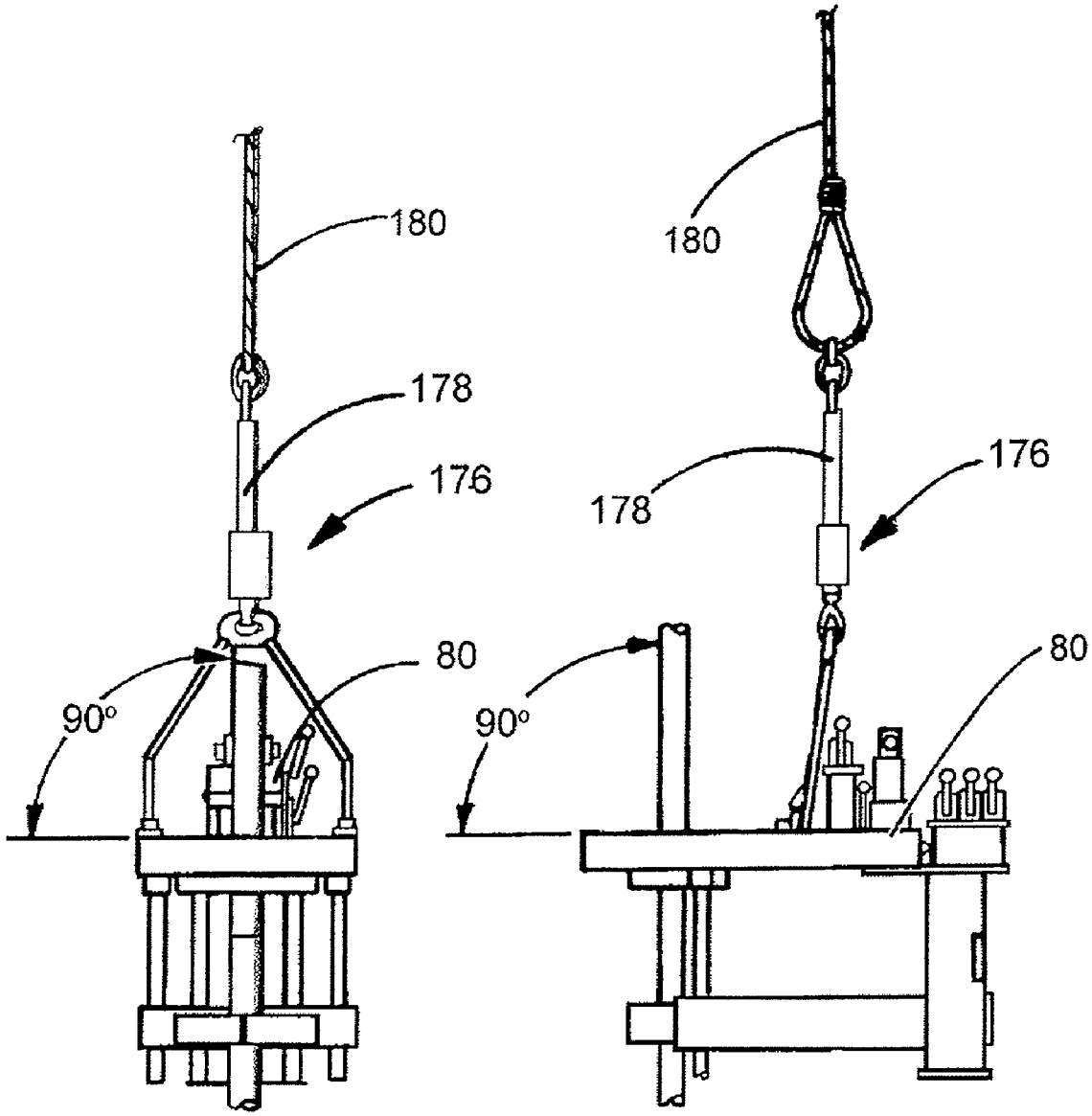
FIG. 19 (PRIOR ART)
FIG. 19 illustrates a lift system for a power tong, known in the art and labeled as "Prior Art;"
Figure 20:
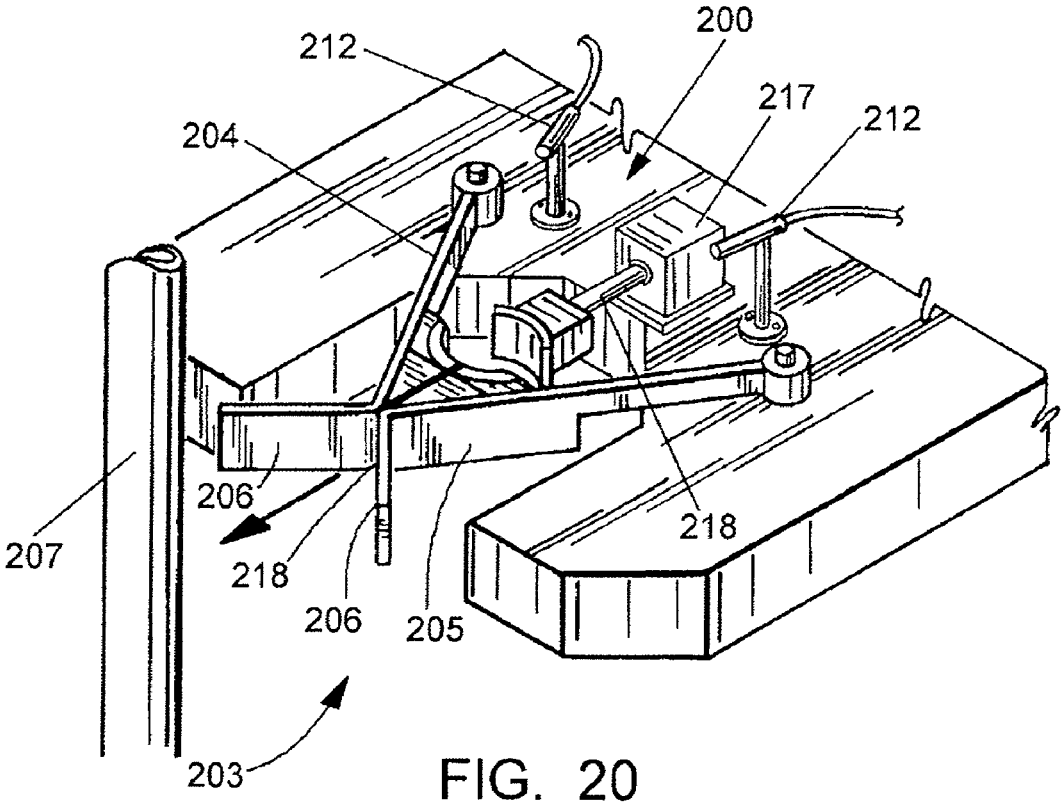
FIG. 20 illustrates an isolated view of the lower tong portion of the present invention.

FIGS. 16 through 18 illustrate yet another protective device for the apparatus. As illustrated, the attachment arm 50 is illustrated in phantom view in FIG. 16. There is provided a plurality of support members 150 positioned above and below the cylinders 60 of the attachment arm 50. As seen in FIG. 17, and in cross section view in FIG. 18, there is provided a cover 153 which is enclosing the cylinders 60 and attachment arm 50, the cover 153 supported on its upper end 154 and lower end 156 by the circular support members 150, illustrated in FIG. 18. Each support member 150 would engage around the arm 50, and have a plurality of arms 152 radiating outward to support frame 151, which would support the cover 153. Therefore, when in use, the movement of the arm and cylinders is protected from the operator inadvertently making contact with the moving parts, and thus avoiding injury.

Figure 25:
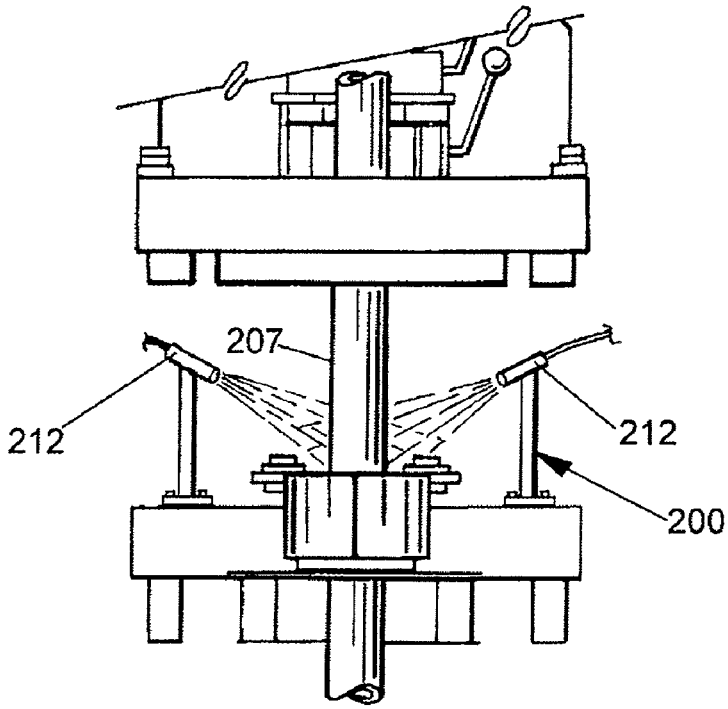
FIG. 25 illustrates a front view of the pipe guide and alignment system of the present invention with a pipe secured therein.
Figure 21:
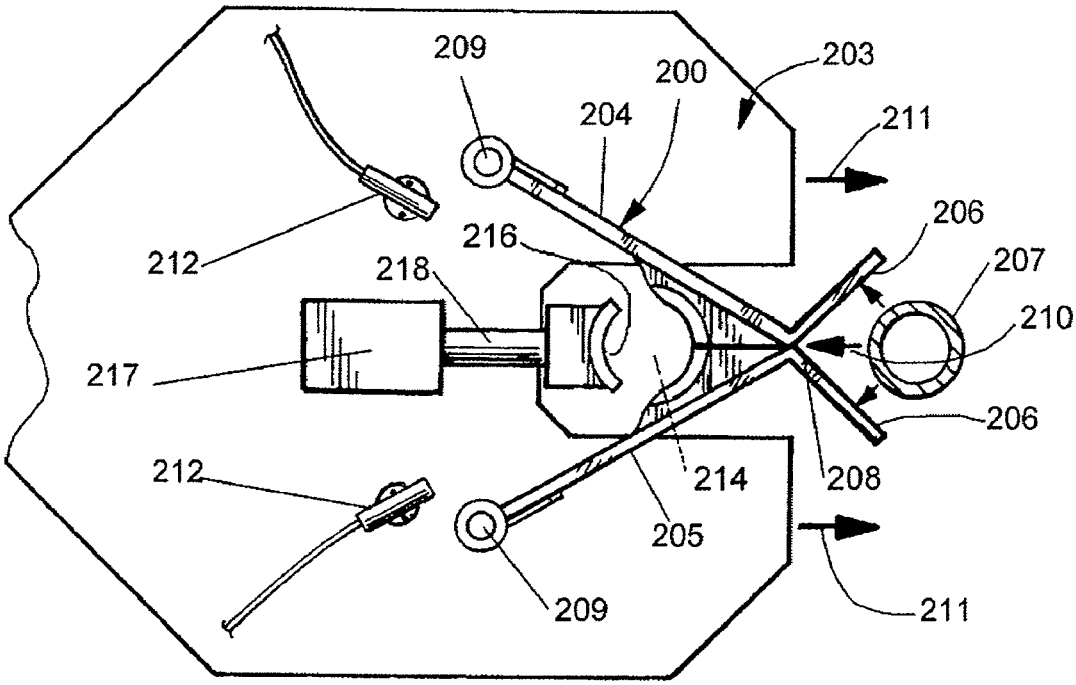
FIG. 21 through 24 illustrate sequential top views of the pipe being engaged into the pipe guide and alignment system.
Figure 22:
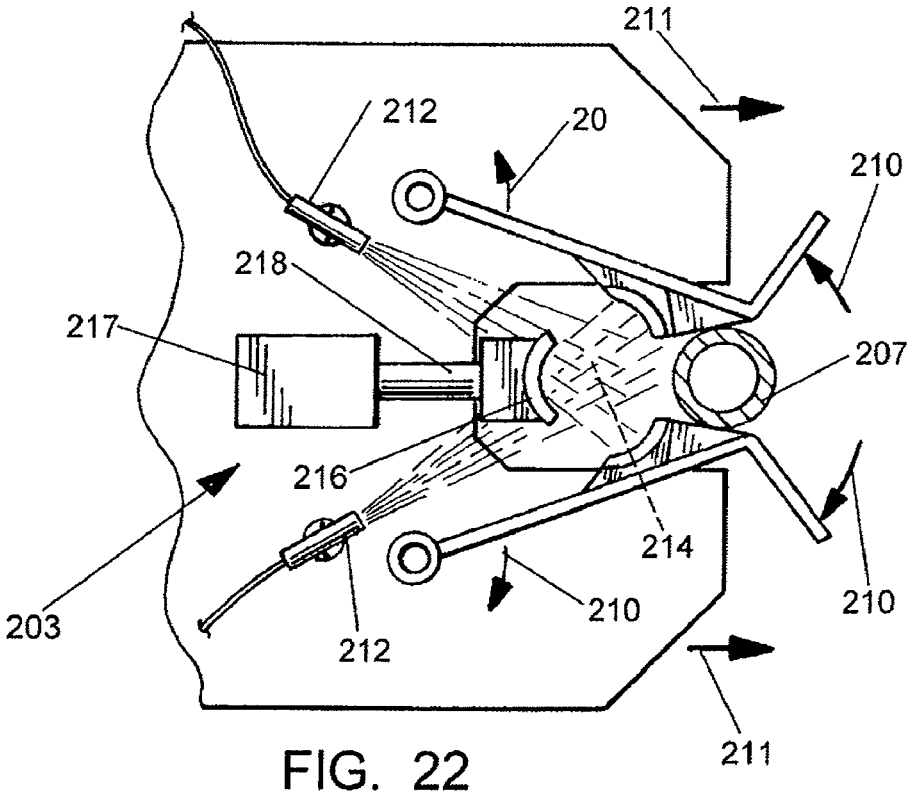
Figure 23:
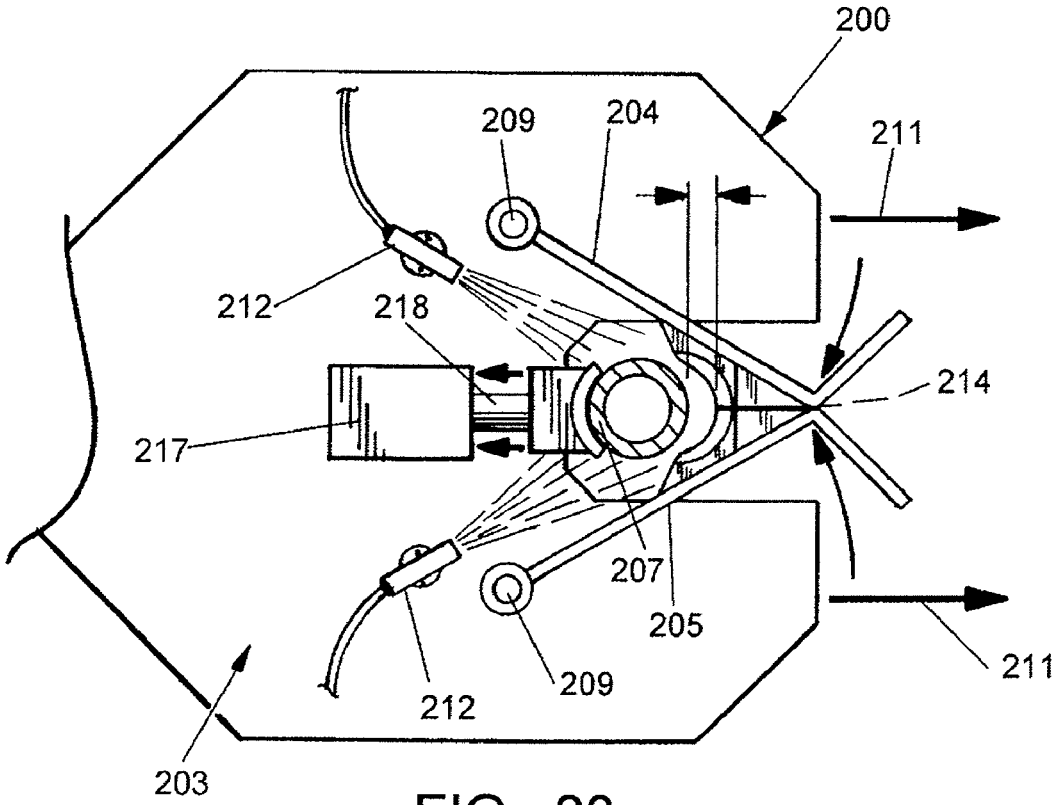
Figure 24:
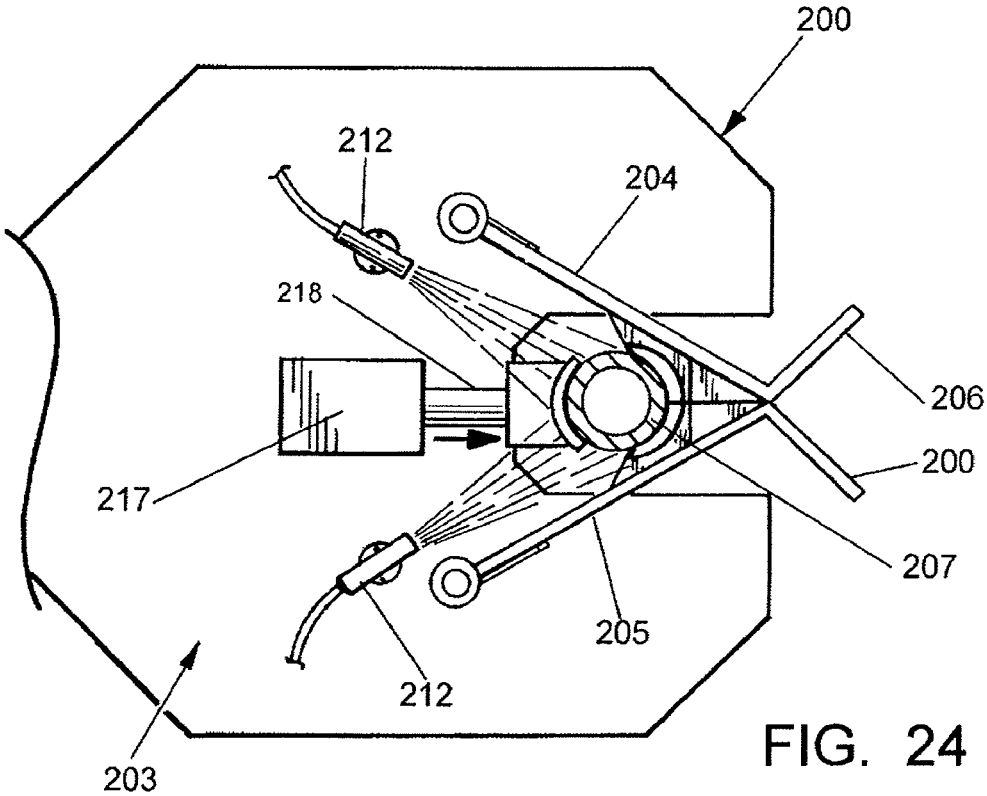
Figure 26:
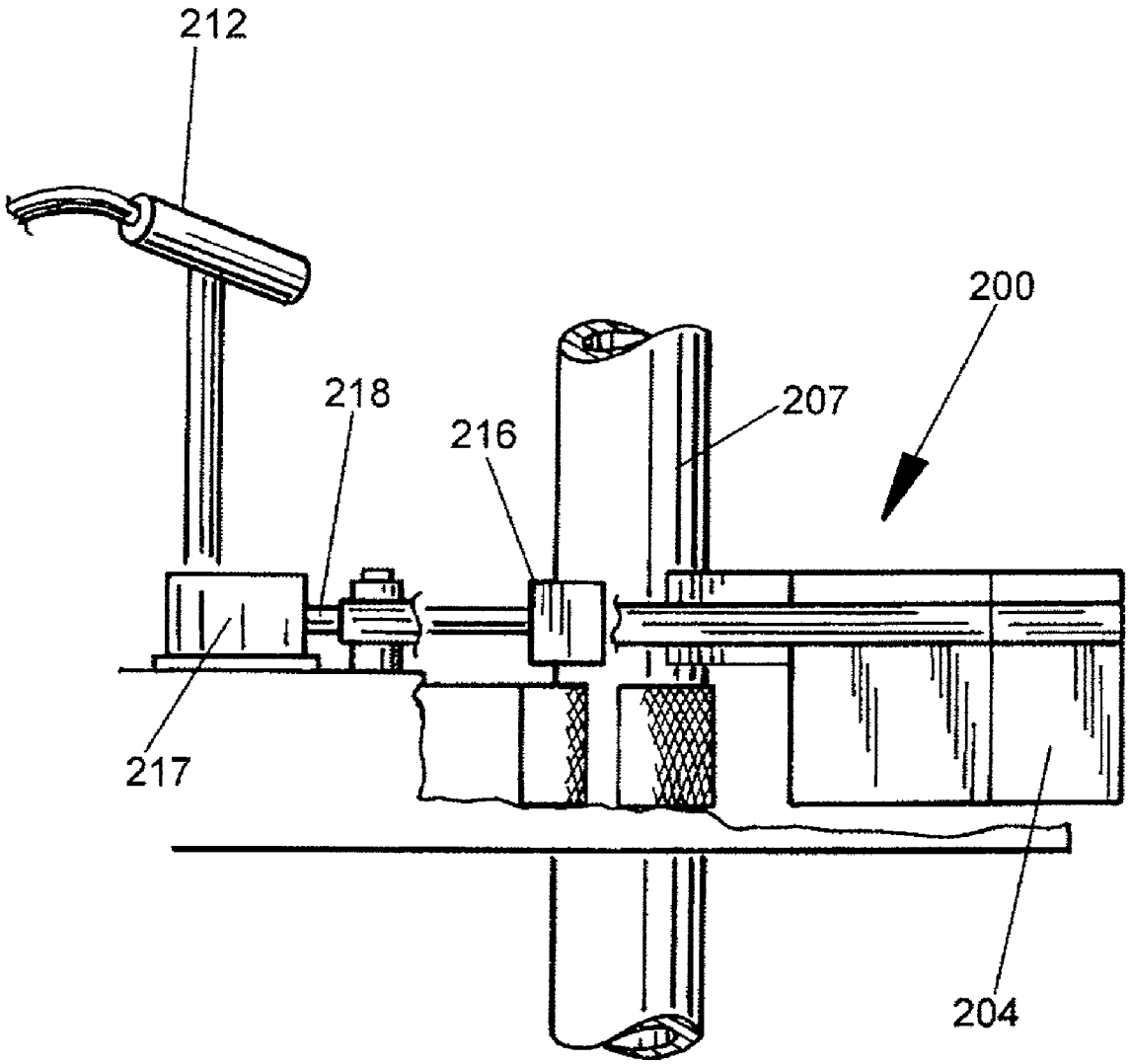
FIG. 26 illustrates a partial side view of a length of pipe secured within the pipe guide and alignment system.

FIGS. 20 through 26 illustrate various views of the pipe guide and alignment system utilized as part of the present invention by the numeral 200. The system 200 would include lower power tong section 203, which is seen in FIG. 21, arrows 211 showing system 200 moving in the direction of pipe 207 for beginning the process. System 200 would include a pair of guide an alignment arms 204, 205, which would be moveable as a length of pipe 207 makes contact with the forward plate portions 206, and the apparatus is guided toward pipe 207, into point 208, as seen in top view in FIG. 21. As the guide arms 204, 205 are contacted by pipe 207, the arms pivot away at pivot points 209, and as seen in FIG. 22, the length of pipe 207 begins to ease into the gap formed between the guide arms 204, 205 as the forward plates 206 begin moving in direction of arrows 210. While this is taking place, reference is made to the pair of cameras 212, which have begun to record the process which is taking place while the pipe 207 into the guide and alignment system. Turning now to FIG. 23, at this point, the pipe 207 has entered into the space 214 defined by the guide arms 204, 205, and the rear alignment pad 216, which extends from the alignment device 217. As the length of pipe 207 moves into space 214, the pipe 207 makes contact with the rear alignment pad 216, at which point the pad 216, affixed to arm 218 extending from device 217, moves rearward to absorb the contact of the pipe 207 against the pad 216, which results in no damage to the pipe wall. In FIG. 24, the pipe 207 is now within space 214, and the alignment arm 218 returns to its position to engage the pipe 207 between the pad 216 and the alignment arms 204, 205. It should be noted that each of the alignment arms 204, 205 each include a guide pad 220, which when the arms are re-engaged, as seen in FIG. 24, the guide pads 220 of the guide arms 204, 205 and the rear pad 216 have the pipe fully engaged for operation. In FIGS. 25 and 26, there is illustrated in full side view and in partial side view, respectively, the lower tong section 203, with a length of pipe 207 engaged therein, and the cameras 212 recording the action. As will be more fully explained below, the cameras 212 are intrinsically safe, explosion proof cameras, and are utilized so that a worker or operator may be undertaking the complete operation as described above from a remote location, while viewing the entire operation in detail, and would not be near the work site which would reduce the chance of accidents. Of course, at any time the operator, if viewing any improper operation, could shut down the tong operation from his remote location.

In conclusion, in the preferred embodiment of the system described above in reference FIGS. 1 through 18 and 20 through 26, the following points should be reiterated.

The utilization of three pivotal points is not limited in this configuration but may include fewer or more pivotal points in the application. The present invention has three basic components which include the base with the rear and forward support elements. The rear support would have a minimal of three pivotal points as was discussed, the lower most pivotal point at a minimum of four degrees, in part to prevent locking of the two pivotally connecting members; on the one part the drive cylinder, and secondly, the pivotal moment arm. Further it allows the drive cylinder to advance or retract the optimum distance with least resistance or restriction in relation to the base. The forward support would have a minimum of three pivotal points at approximately four degrees, partly to prevent locking of the two pivotally connecting members, on the one part the drive cylinder and secondly, the pivotal moment arm; and further to allow the drive cylinder to advance or retract the optimum distance with least resistance or restriction; and further in relation to the pivotal connection of the cylinder in relation to the horizontal base and the vertical rear support when attached to the forward moment arm in pivotal relation with the drive cylinder or forward attachment arm. There may be included a hydraulic limiting switch, cell or in-line valve which is utilized to prevent excessive flow of hydraulic fluid into and out of the cylinder 24.

The second component would be the frame and cover, as was discussed in relation to FIGS. 13-15, which may be a metal retractable design or a flexible industrial grade material which may be also suitable.

The third component or the power drive would be designed whereby a hydraulic cylinder/air cylinder or other suitable driver as previously discussed activates the pivotal moment arm attached to the shock absorbing tool downwardly at approximately four degrees in part to prevent locking of the two connecting members and further to allow the drive cylinder to advance or retract the optimum distance with least resistance or restriction and toward the forward support. The power source may be diesel driven or otherwise, forced air pressure, electronic signaling with sender and receiver or other similar power source. The power driver may be diesel driven hydraulics, other hydraulics, forced air pressure or electronic signaling with sender and receiver. The cylinder may be hydraulic or air cylinder. Additional power source may utilize a cam over action utilizing belt, chain or similar device or there may even be a rail system advanced by a chain drive rather than utilizing the hydraulic cylinder.

In the points to be made about the power drive applicant would make the following points:

Moment Arm Attachment is lower rear pivotally attached to cylinder with a cushion or shock type device at a minimum 4-degree deviation relative to the horizontal base.

Forward Shock Attachment Arm connected rear to the Forward Pivot Point on the Moment Arm which connects pivotally on the forward support member at one of three minimum pivotal points on the Moment arm.

The forward pivotal point of the Moment Arm is designed whereby the Attachment Arm is secured at a pivotal point whereby when the Apparatus is in a delivery or storage mode, the Forward Attachment Arm is secured in a vertical position while remaining connected with the Moment Arm.

The Tong Frame Attachment Point pivotally connects both vertically and horizontally to the Forward Attachment Shock. The Shock Apparatus is designed such as to limit sudden jerking motion both vertically and horizontally.

The design of this apparatus is such that a prior art vertical positioning apparatus 176 as seen in FIG. 19 of the prior art, the hydraulic cylinder 178 connecting on one upper end to the rig cable 180 and to the lower end the power tong 80 may be utilized in combination with the apparatus.

Further to this invention, as was referred to and described in FIGS. 20 through 26, as the power tong engages each pipe section to be screwed together, this invention utilizes the pipe guide and alignment system 200, which includes the optical features, that includes the lower tong or (back-up tong) be equipped with tubular guide plates vertically aligned on each side of the opening of the lower tong whereby the upper and lower tong easily mates with each tubular or pipe section prior to make up.

The tubular tong guide is connected to the lower tong by 1" square tubing or the like to the rear and to each side of the lower tong throat by ¾" threaded bolts, each comprising a spacer with swivel capability, with a lock washer and threaded nut to hold the alignment guide system in place. The system is designed specially to be utilized with chrome tubulars and is further specially coated to minimize damage to the chrome tubular while putting the tong in place on each tubular section prior to makeup.

This invention specifically utilized the tubular guide system attached to the lower forward section of the power tong but secured to each side and to the rear of the lower tong throat which receives the tubular section and protrudes forward and downward of the lower tong to guide the pipe section into the jawed lower tong throat area and is an integral part of the Optical Guide and Alignment System.

Further to the Optical Guide and Alignment System and designed and attached thereto, tong door controls are used as the tong and backup are readied for makeup, the tong operator utilizes and functions the (automatic air) controls from his normal operating position for the opening and closing of the forward door of the tong which eliminates any contact by the rig crew with moving parts which may cause injury to those rig crew members not knowledgeable with such technology.

An alternative to the above, the apparatus is designed to be remotely operated with said remote controls functioning as a result of hydraulic, air, air over hydraulics, electronic power, for example, equipment developed by Hydraquip to remotely control an oil well completion frac unit for Petrotool Company. Remote operation in this instance includes but in not limited to control of the tong positioning system by the tong operator but may also include operation by the driller who controls the drawworks while pulling and running of the tubulars and additionally has full responsibility for all other activities while on the rig floor.

Further as a means of visual acuity, with intrinsically safe cameras mounted in such position and location that (such) close visual may be observed are positioned opposing intrinsically safe video cameras for digitally recording the address and makeup of the threaded pipe connection with the idea of eliminating potential problems before the Tubular is run down hole. By utilizing video cameras, monitors may be placed in strategic locations such as on the tong whereby the tong operator may respond immediately to any adverse condition regarding the makeup of one pipe section to another pipe section or in the rig supervisor's office for immediate feedback and further a digital or VHS recording is made and is available for evaluation should a problem be identified later during the completion process. For example, during a wire line procedure, the wire line tool may become stuck inside a pipe section and will not go downhole which may indicate crimped pipe. Crimped pipe may be a result of improper alignment of one pipe section to another pipe section causing crossed threading, improper torque applied by the tong or the upper tong or lower tong back up gripping the pipe section improperly.

Further to the positioning of the tong on each chrome tubulars, there may be mounted on the lower tong electronic/hydraulic alignment (positioning) pads that determine the predisposition of each tubular section prior to screwing together to assure that the threaded body is properly aligned and will not cross thread, show a bad torque turn graph or gall while connecting sections together.

The positioning pads are designed relative to the vertical positioning and orientation of each Tubular in relation to the jaw/die on the upper tong and/or jaw/die lower tong configuration. This positioning and alignment is critical to eliminate damage to the chrome tubular once the Tong is energized and the jaw/die makes contact with the Chrome Tubular section.

Most chrome tubular sections with premium connections are made up utilizing a torque turn system with a electronic dump which prevents over torque that may result in bulging or deformity of the connection. Connection Technology Inc. of Belle Chasse, La. sells one Torque Turn System.

Further, the positioning pad most rear to the centering positioning of the tubular section in the well bore shall be so designed as to have a padded shock-absorbing propensity or cushion effect on the chrome tubular to prevent damage as each tubular section is positioned for makeup.

Further to the above tong positioning apparatus which utilizes the standard Rig provided cable as seen in the prior art FIG. 19, to support the prior art lift/positioning cylinder, another method to handle the tong or other such heavy items on the rig floor is to utilize the stand alone hydraulic system. This tong positioner shall be free standing and fully support the tong; however, this tong positioning apparatus is designed to be utilized in larger deepwater applications. The apparatus is designed to function as a 'stand alone' tong positioner, utilizing some characteristics as incorporated in a rig mounted crane with swivel mounted base for multi-directional utilization.

Figure 27:
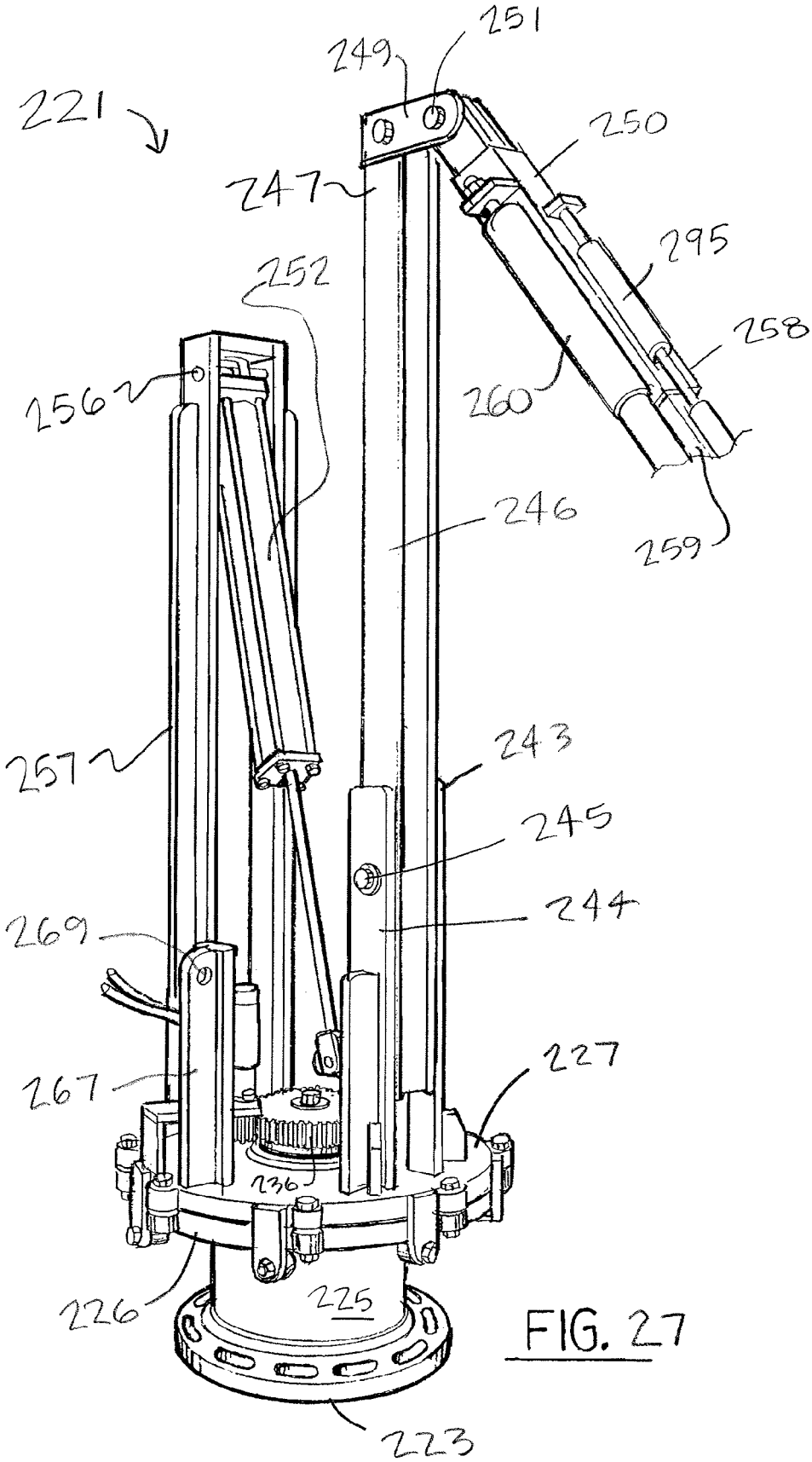
FIG. 27 is a perspective view of a second embodiment of the apparatus of the present invention.
Figure 28:
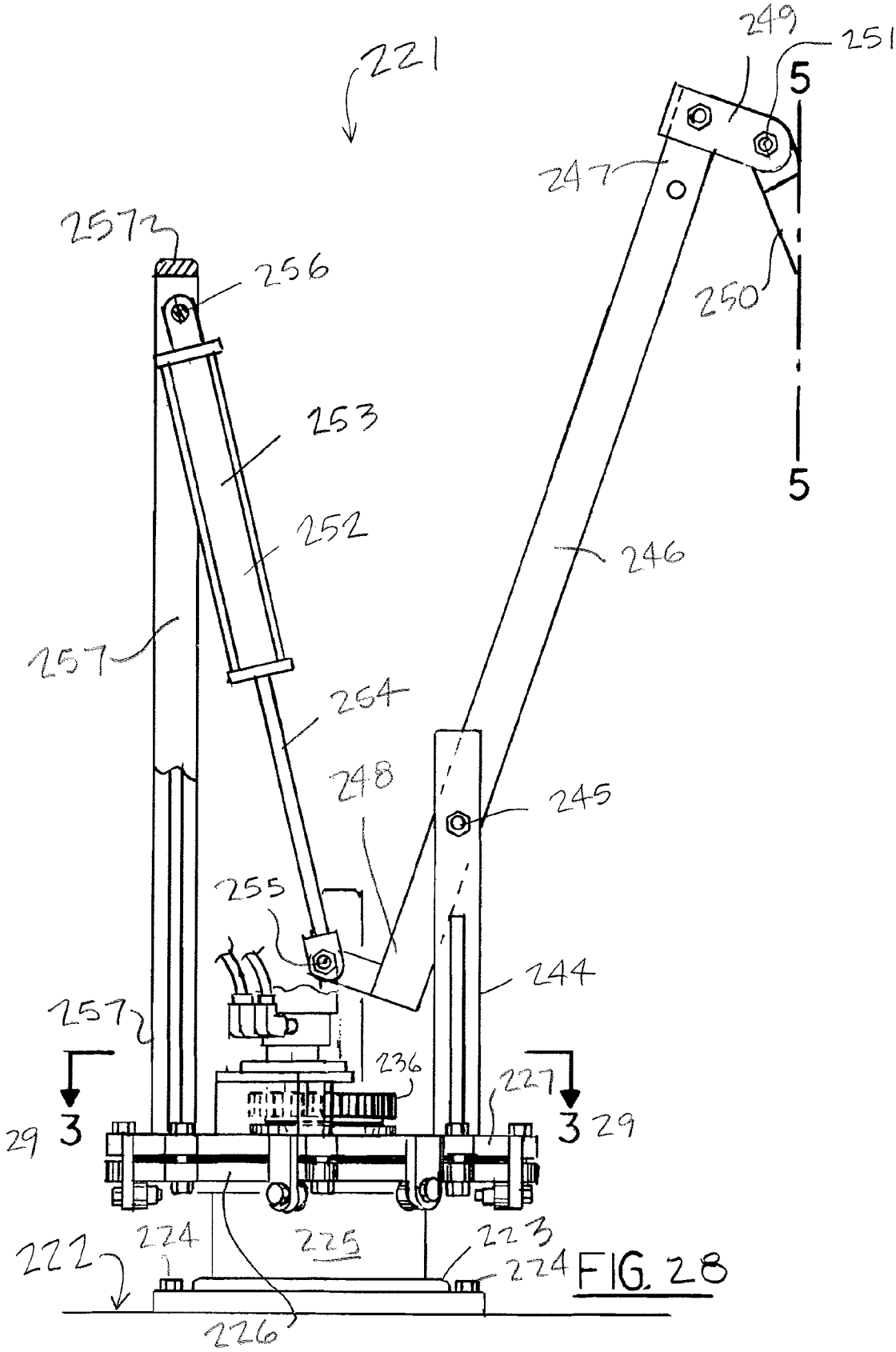
FIG. 28 is an elevation view of the second embodiment of the apparatus of the present invention.

FIGS. 27-37 show a second embodiment of the apparatus of the present invention designated generally by the numeral 221. Tong positioning apparatus 221 can be mounted in a selected location such as upon a well drilling rig floor 222. Tong positioning apparatus 221 has a lower base 223 that can be affixed to a rig floor 222 or other underlying support surface using for example bolted connections 224. Pedestal 225 can be generally cylindrically shaped and extends upwardly from base 223 as shown in FIGS. 27 and 28. Pedestal 225 supports lower plate 226 which is affixed to pedestal 225, for example by welding. Upper plate 227 rotates relative to lower plate 226. A generally frictionless bearing layer 228 (e.g. Teflon®) can be placed in between lower plate 226 and upper plate 227.

Figure 29:
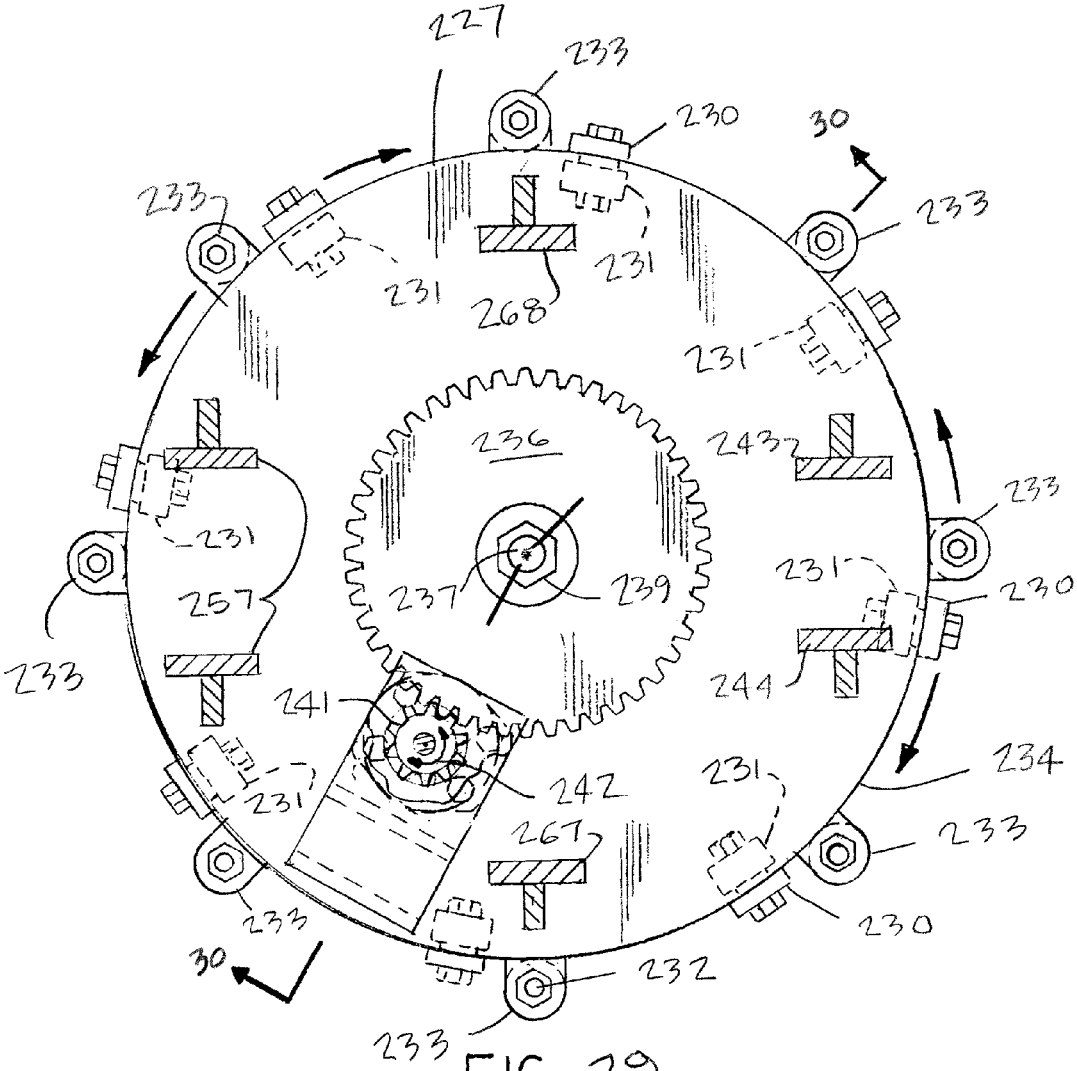
FIG. 29 is a sectional view taken along lines 29-29 of FIG. 28.
Figure 30:
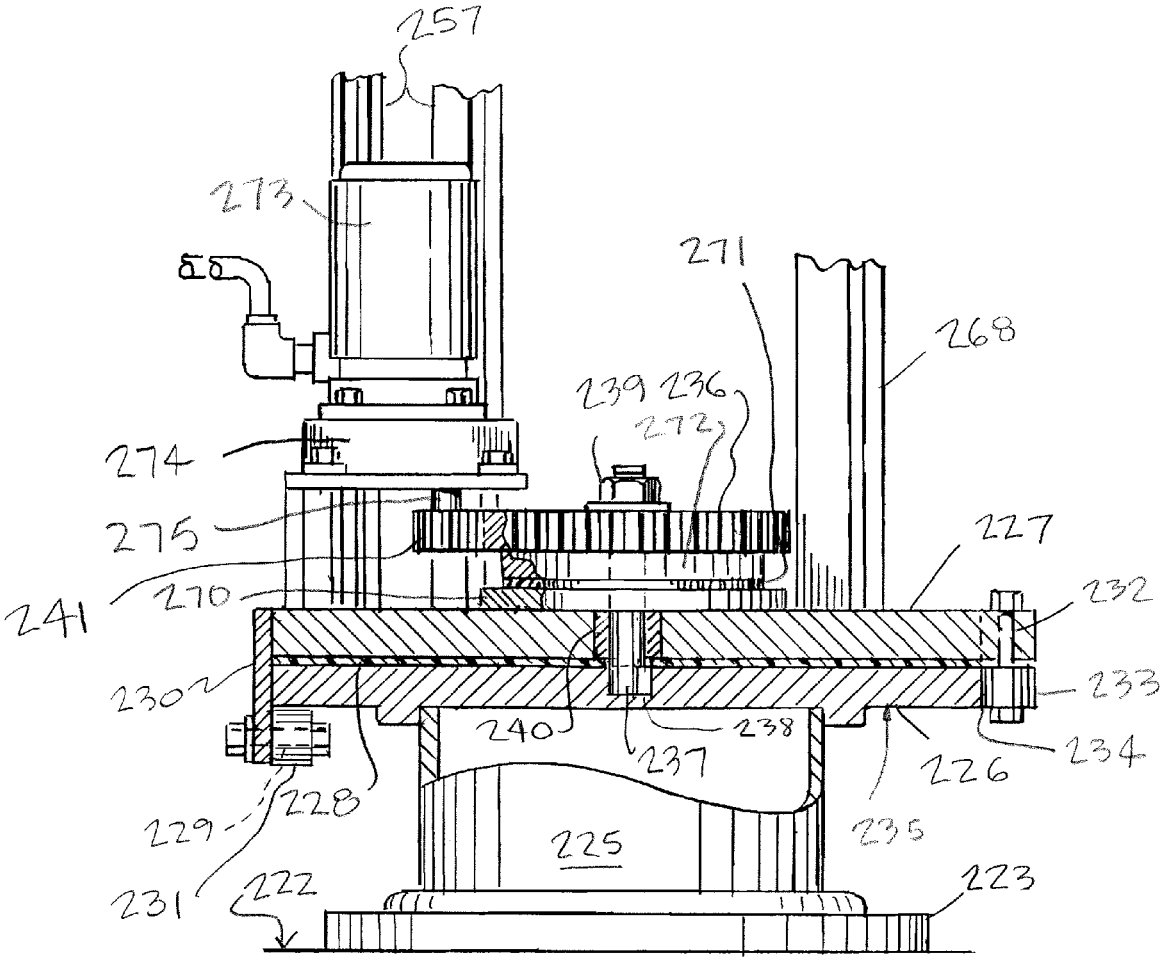
FIG. 30 is a sectional view taken along lines 30-30 of FIG. 29.
Figure 31:
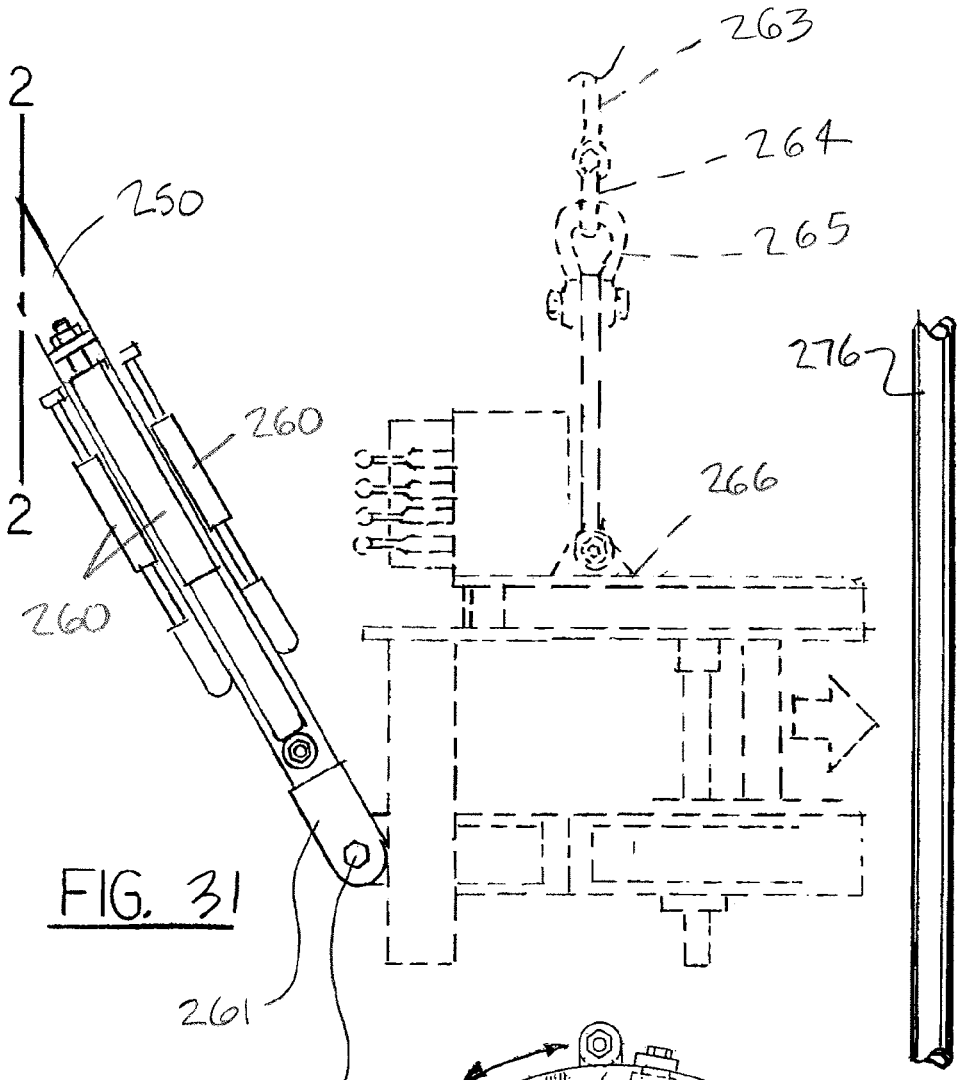
FIG. 31 is a fragmentary elevation view of the second embodiment of the apparatus of the present invention.

In FIGS. 29 and 30, a plurality of rollers 231, 233 can be provided for maintaining alignment of the plates 226, 227. In that regard, a plurality of vertical plates 230 can be attached to upper plate 227 as shown in FIGS. 29 and 30. Horizontal shaft 229 is attached to plate 230 and supports roller 231. Each roller 231 engages the under surface 235 of lower plate 226. A plurality of vertical shafts 232 can be attached to the periphery of upper plate 227 as shown for example in FIG. 4. Each roller 233 engages the periphery 234 of lower plate 226. Each roller 233 is mounted upon vertical shaft 232.

A motor drive and gear arrangement can be used to rotate upper plate 227 relative to lower plate 226. In FIGS. 27-30, the motor drive and gear arrangement can provide a hydraulic motor 273, gear box 274, and gear 241. The gear 241 is a smaller gear that engages larger gear 236. The larger gear 236 can provide a plate with shoulder 272. Plate with shoulder 272 is mounted upon bearing layer 271. The bearing layer 271 is mounted upon spacer plate 270 that extends upwardly from plate 227 as shown in FIG. 30. Shaft 275 extends downwardly from gear box 274 and attaches gear 241 to gear box 274.

A vertical shaft 237 is attached to lower plate 226 using key 238. Gear 236 rotates with respect to shaft 237. Bolt 239 secures gear 236 to shaft 237 as shown in FIG. 4. A sleeve 240 can be provided as a bearing in between rotating plate 227 and shaft 237 as shown in FIG. 30. Arrow 242 in FIG. 29 shows that when gear 241 rotates, it also rotates gear 236 and plate 227.

Columns 243, 244 support intermediate member 246. Intermediate member 246 is mounted to columns 243, 244 using pivotal connection 245. The intermediate member 246 has an upper end portion 247 and a lower end portion 248. At the upper end portion 247, a link 249 enables a pivotal connection at 251 to be formed with forward member 250.

Hydraulic cylinder 252 has end portions that connect to forward member 246 at pivotal or pinned connection 255 and to column 257 at pinned or pivotal connection 256. The hydraulic cylinder 252 includes a cylinder 253 and pushrod 254. As the hydraulic cylinder expands or contracts, the pinned connection 255 moves toward or away from cylinder 253 thus rotating intermediate member 246 relative to pinned connection 245. This action either lowers and projects forward, or elevates and retracts forward—the member 250. In FIG. 27, forward member 250 is elevated to its maximum position when hydraulic cylinder 252 is fully expanded as shown.

Figure 38:
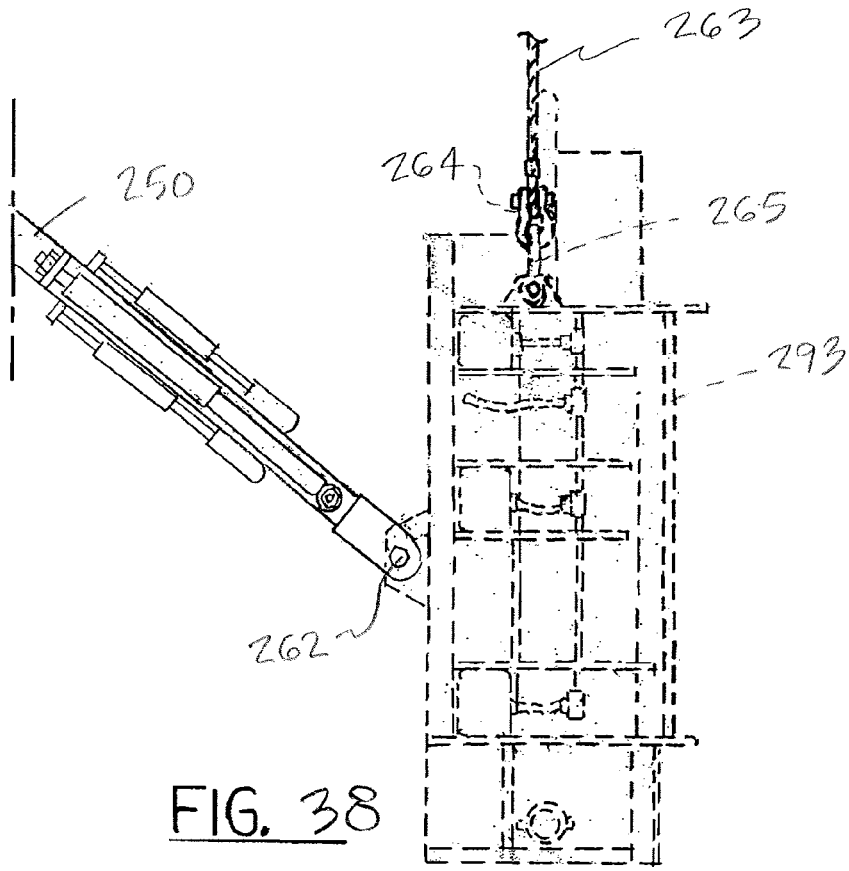
FIG. 38 is a fragmentary elevation view of the second embodiment of the apparatus of the present invention showing the supporting of a mud bucket.
Figure 39:
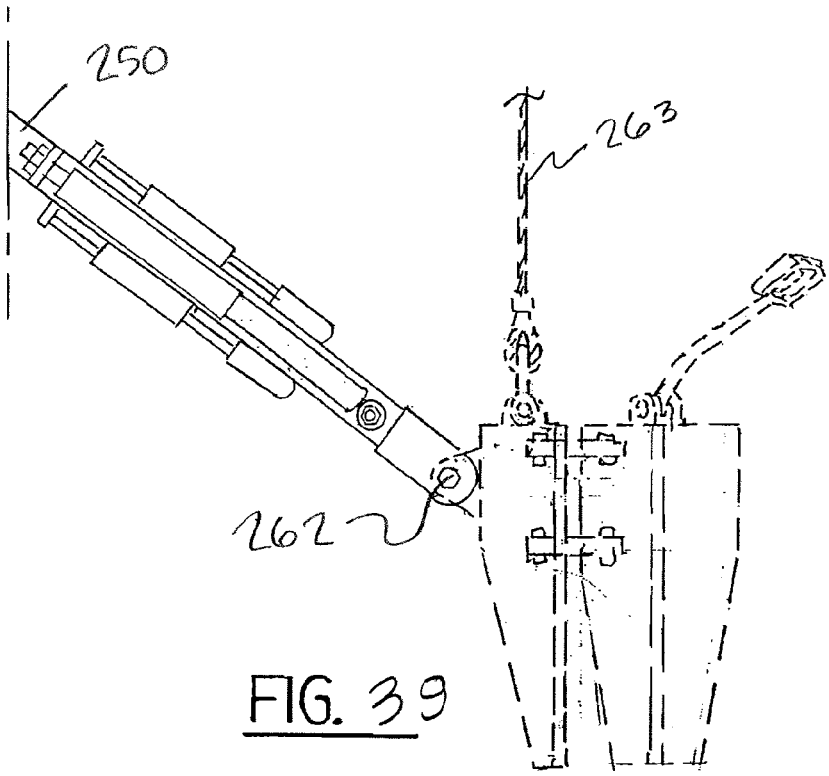
FIG. 39 is a fragmentary elevation view of the second embodiment of the apparatus of the present invention showing the supporting of a set of slips.

Forward member 250 is a telescoping member that includes upper section 258 and lower section 259. A pair of shock absorbers 260 can be attached at end portions to upper section 258 and lower section 259 respectively (see FIGS. 36, 37). Forward member 250 provides a lower end portion 261 that can be attached at pivotal connection or pinned connection 262 to an item to be lifted such as the power tong 266 shown in FIG. 31, the mud bucket 293 shown in FIG. 38, or the slips 294 shown in FIG. 39. Guides 295 can also be affixed respectively to upper section 258 and lower section 259 of forward member 250 to help maintain alignment of the sections 258, 259 in combination with the shock absorbers 260.

When handling a power tong 266, mud bucket 293, slips 294, or other item (see FIGS. 38, 39), a crane lifting line 263 is employed that provides a lifting implement such as a hook 264 or shackle for attaching to an additional shackle 265 or other rigging for forming an interface between the item to be lifted 266, 293, 294 and the crane lifting line 263.

The apparatus 221 of the present invention can be lifted using columns 267, 268 each of which is provided with an opening 269. In this fashion, a lifting device such as a crane can be attached to the column or columns 267, 268 at opening 269 using a shackle or other rigging.

Figure 32:
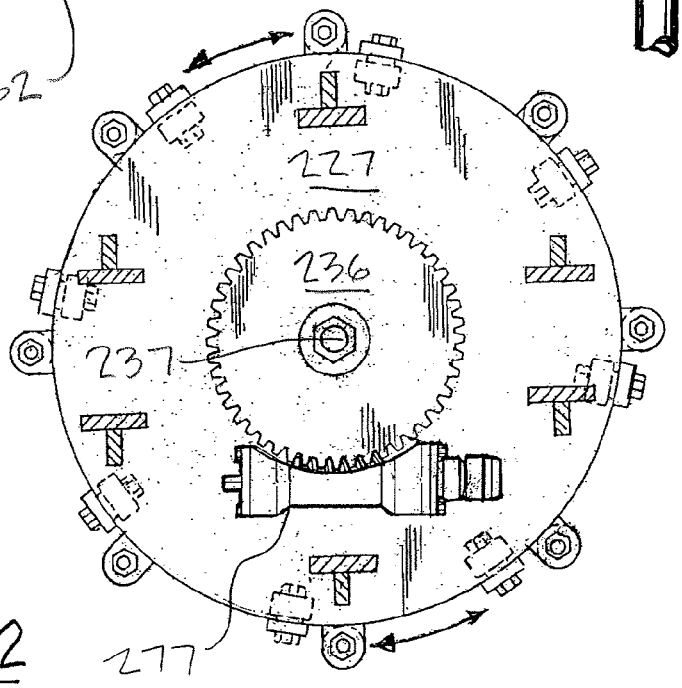
FIG. 32 is a sectional view of the second embodiment of the apparatus of the present invention, taken along lines 29-29 of FIG. 28 and illustrating an alternate rotating device in the form of a worm gear arrangement.

FIG. 32 illustrates that a different type of motor drive arrangement could be used for rotating gear 236. In FIG. 32 for example a worm gear motor drive 277 is shown engaging gear 236. Operation of the worm gear motor drive 277 rotates gear 236 and plate 227.

Figure 33:
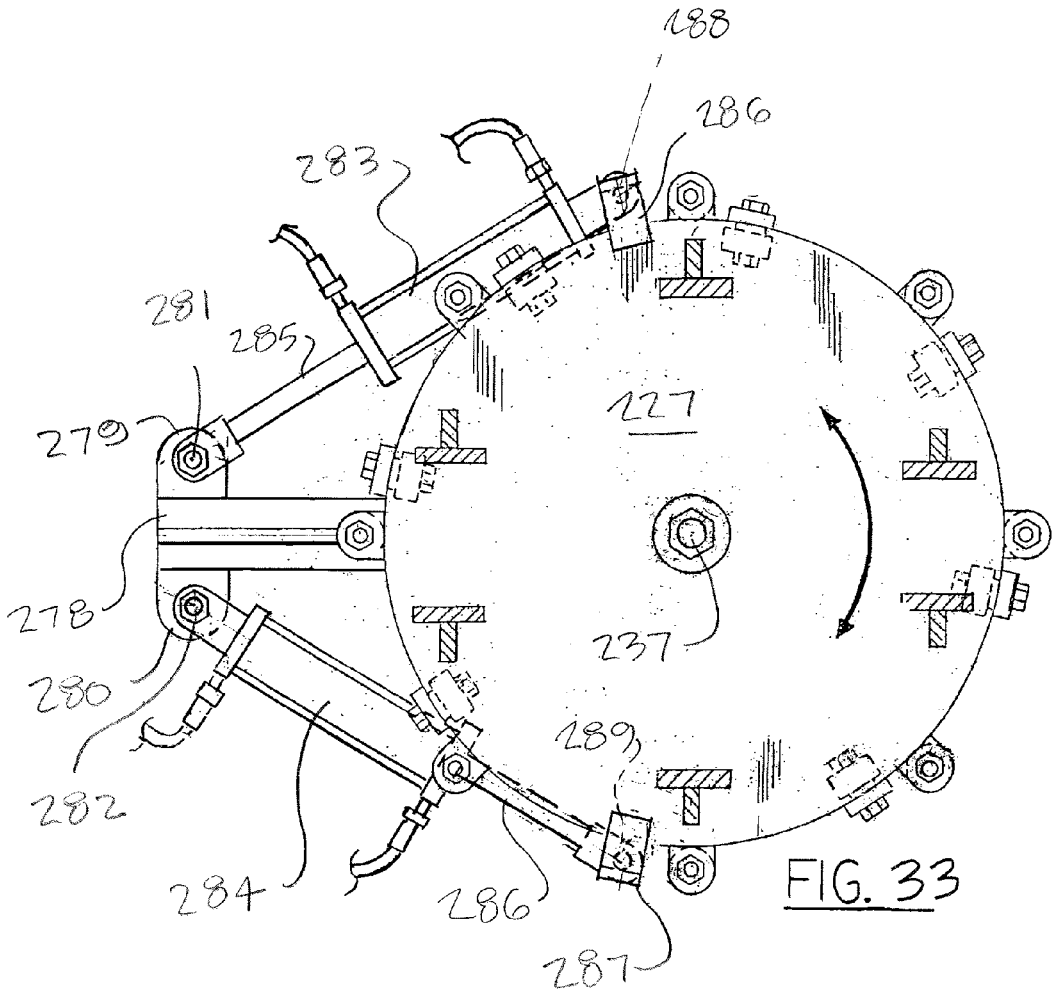
FIG. 33 is a partial sectional view of the second embodiment of the apparatus of the present invention, and illustrating an alternate rotating mechanism in the form of two angularly oriented hydraulic cylinders.
Figure 34:
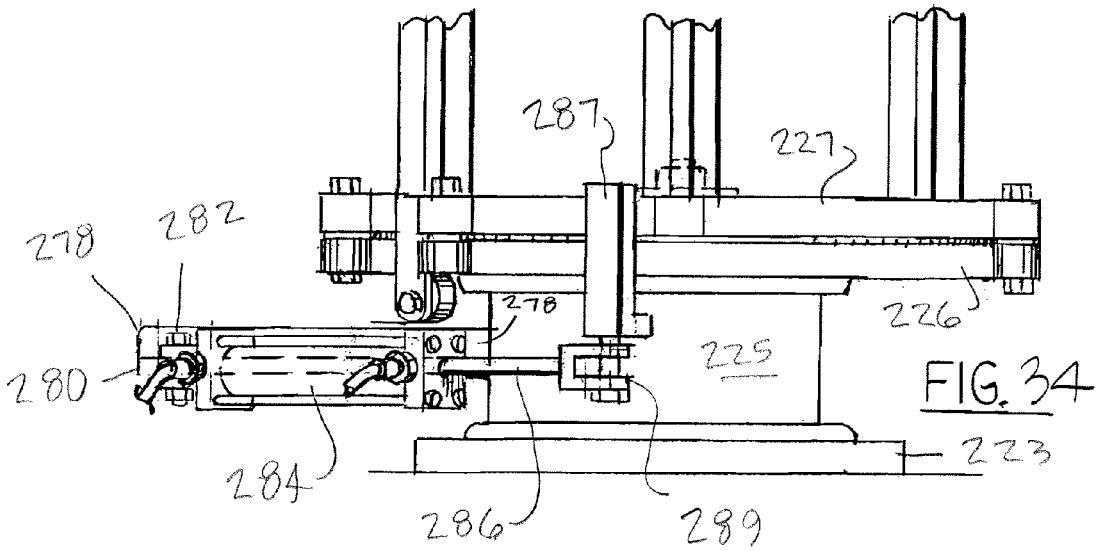
FIG. 34 is a side view of the hydraulic cylinder arrangement of FIG. 33.
Figure 35:
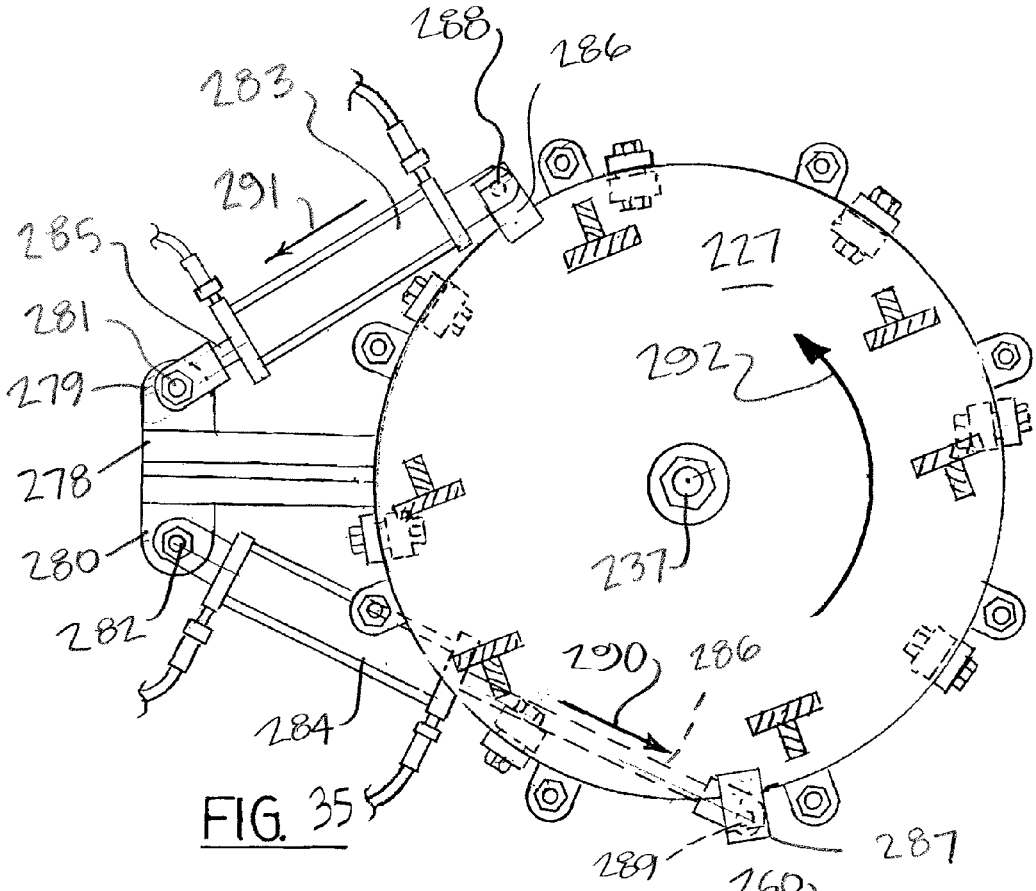
FIG. 35 is a plan, sectional view showing the hydraulic cylinder arrangement of FIGS. 33 and 34 wherein one cylinder has extended for rotation of the apparatus in a counterclockwise direction, the other cylinder having been retracted.
Figure 36:
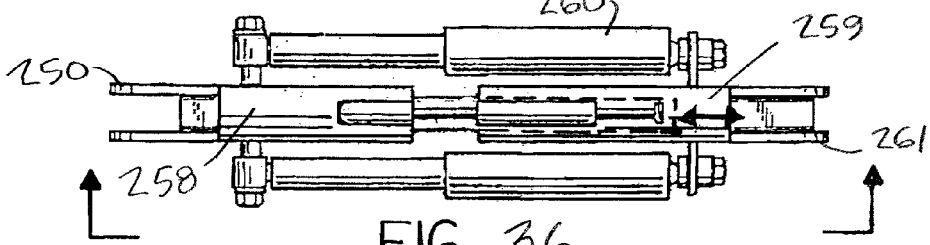
FIG. 36 is a fragmentary view of the preferred embodiment of the apparatus of the present invention.
Figure 37:
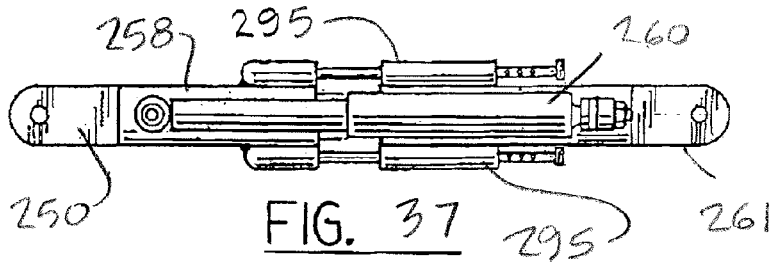
FIG. 37 is a sectional view taken along lines 37-37 of FIG. 36.

FIGS. 33-35 show yet another arrangement for rotating the plate 227 relative to the plate 226. In FIGS. 33-35, a cylinder support 278 is attached (for example, welded) to pedestal 225. The cylinder support 278 provides a pair of opposed lugs 279, 280. A pivotal connection is formed between each lug and a hydraulic cylinder. In FIGS. 33-35, hydraulic cylinder 283 is attached to lug 279 at pivotal connection 281. Hydraulic cylinder 284 is attached to lug 280 at pivotal connection 282. Each hydraulic cylinder provides a pushrod. Cylinder 283 provides pushrod 285. Cylinder 284 provides pushrod 286. Each pushrod attaches to plate 227 using a lug and pivotal connection. Pushrod 283 attaches to plate 227 at lug 286 using pivotal connection 288. Similarly, pushrod 284 attaches to plate 227 using lug 287 and pivotal connection 289. In FIG. 35, arrow 290 illustrates an expansion of hydraulic cylinder 284 so that its pushrod 286 assumes the fully extended position shown in FIG. 35. In FIG. 35, the cylinder 283 shows a fully retracted position wherein its pushrod 285 has been fully withdrawn, this combined action of the hydraulic cylinders 283, 284 effecting a rotation at plate 227 in the direction of arrow 292.

The obvious benefits include fewer personnel in safer enclosed environment; safer for the rig floor personnel; faster with ability to move heavier equipment with less effort; maximizes efficiency and saves time.

The following is a list of suitable parts and materials for the various elements of the preferred embodiment of the present invention.

PARTS LIST

| Parts Number | Description |
|---|---|
| 10 | tong positioning device |
| 12 | base member |
| 14 | flat base plate |
| 16 | lifting eye |
| 17 | rig floor |
| 18 | rectangular box |
| 20 | walls |
| 22 | hydraulic cylinder |
| 24 | piston member |
| 26, 28 | lines |
| 30 | first end |
| 32 | rear support member |
| 34 | first lower port |
| 36 | pin |
| 38 | cotter pin |
| 40 | moment arm |
| 44 | upper end |
| 46 | plate members |
| 42 | inner arm member |
| 48 | bores |
| 50 | forward shock attachment arm |
| 49 | bore |
| 47 | forward upright support member |
| 60 | frames |
| 62 | upright members |
| 64 | point |
| 66 | horizontal members |
| 67 | ends |
| 53 | u-shaped connector member |
| 55 | bolt |
| 57 | bolt |
| 54, 56 | first and second portions |
| 60 | cylinders |
| 70 | shock absorbing member |
| 59 | second end |
| 72 | points |
| 73, 75 | sections |
| 74 | tong support member |
| 76 | bolt |
| 80 | power tong |
| 90 | pipe |
| 100 | cable |
| 82 | handles |
| 84 | handles |
| 102 | arrow |
| 105 | arrow |
| 106 | arrow |
| 108 | arrow |
| 109 | arrow |
| 110 | arrow |
| 114 | arrow |
| 120 | rectangular box portion |
| 122 | sidewalls |
| 124 | upper wall |
| 126 | rear wall |
| 128 | interior space |
| 130 | front face |
| 131 | second component |
| 132 | upright portion |
| 134 | sidewalls |
| 135 | plate |
| 136 | end wall |
| 137 | point |
| 138 | upper portion |
| 139 | arrow |
| 140 | top portion |
| 142 | forward phase |
| 134 | semi-circular plate |
| 135 | point |
| 136 | arrow |
| 150 | support members |

-continued

PARTS LIST

| Parts Number | Description |
|---|---|
| 151 | support frame |
| 152 | arms |
| 153 | cover |
| 154 | upper end |
| 156 | lower end |
| 160 | scaffolding |
| 162 | scaffold board |
| 164 | first frame |
| 166 | single leg |
| 168 | support frame |
| 170 | opening |
| 171 | second frame |
| 172 | legs |
| 174 | opening |
| 176 | vertical positioning apparatus |
| 178 | hydraulic cylinder |
| 180 | rig cable |
| 200 | guide and alignment system |
| 203 | lower power tong section |
| 204, 205 | tubular guides |
| 206 | forward portions |
| 208 | point |
| 209 | pivot points |
| 210 | arrows |
| 211 | arrows |
| 212 | cameras |
| 214 | space |
| 216 | rear alignment pad |
| 217 | alignment device |
| 218 | arm |
| 220 | guide pads |
| 221 | tong positioning apparatus |
| 222 | well drilling rig floor |
| 223 | base |
| 224 | bolted connection |
| 225 | pedestal |
| 226 | lower plate |
| 227 | upper plate |
| 228 | bearing layer |
| 229 | horizontal shaft |
| 230 | vertical plate |
| 231 | roller |
| 232 | vertical shaft |
| 233 | roller |
| 234 | periphery |
| 235 | under surface |
| 236 | gear |
| 237 | vertical shaft |
| 238 | key |
| 239 | bolt |
| 240 | sleeve |
| 241 | gear |
| 242 | arrow |
| 243 | column |
| 244 | column |
| 245 | pivotal connection |
| 246 | intermediate member |
| 247 | upper end portion |
| 248 | lower end portion |
| 249 | link |
| 250 | forward member |
| 251 | pivotal connection |
| 252 | hydraulic cylinder |
| 253 | cylinder |
| 254 | pushrod |
| 255 | pivotal connection |
| 256 | pivotal connection |
| 257 | column |
| 258 | upper section |
| 259 | lower section |
| 260 | shock absorber |
| 261 | lower end portion |
| 262 | pivotal/pinned connection |
| 263 | crane lift line |
| 264 | crane hook |

-continued

PARTS LIST

| Parts Number | Description |
|---|---|
| 265 | shackle |
| 266 | power tong |
| 267 | column |
| 268 | column |
| 269 | opening |
| 270 | spacer plate |
| 271 | bearing layer |
| 272 | shoulder |
| 273 | hydraulic motor |
| 274 | gear box |
| 275 | shaft |
| 276 | drill pipe |
| 277 | worm gear motor drive |
| 278 | cylinder support |
| 279 | lug |
| 280 | lug |
| 281 | pivotal connection |
| 282 | pivotal connection |
| 283 | hydraulic cylinder |
| 284 | hydraulic cylinder |
| 285 | pushrod |
| 286 | lug |
| 287 | lug |
| 288 | pivotal connection |
| 289 | pivotal connection |
| 290 | arrow |
| 291 | arrow |
| 292 | arrow |
| 293 | mud bucket |
| 294 | slip |
| 295 | guide |

The foregoing embodiments are presented by way of example only; the scope of the present invention is to be limited only by the following claims.

The invention claimed is:

1. An improved tong positioning device, comprising:

a) a base;

b) an intermediate member pivotally attached to the base with a pivot, the intermediate member having lower and upper end portions positioned in opposing directions from the pivot;

c) a power source being an elongated extensible member attached to a lower end of the intermediate member and spanning between the base and the lower end portion of the intermediate member;

d) a forward member attached to the upper end portion of the intermediate member; and e) a free end of the forward member secured to a tong, so that pivotal movement of the intermediate member imparted by the power source to the lower end portion of the intermediate member imparts movement of the tong between engaged and disengaged positions around tubular members.

2. The improved tong positioning device of claim 1, wherein the power means comprises a hydraulic cylinder.

3. The improved tong positioning device of claim 1, wherein the power means comprises an air cylinder.

4. The improved tong positioning device of claim 1, wherein the intermediate member is attached to an end of a piston of the hydraulic cylinder.

5. The improved tong positioning device of claim 1, wherein the intermediate member is driven by the power source means to impart pivoting motion to the forward member and forward and backward motion to the tong.

6. The improved tong positioning device of claim 1, further comprising a protective shield positionable over the device so that minimum contact with the moving parts of the device by an operator is achieved.

7. The improved tong positioning device of claim 1, wherein the base has rotating and fixed portions and a driver that powers a rotation of the movable portion relative to the fixed portion.

8. The improved tong positioning device of claim 1, wherein the forward member defines a forward shock absorbing arm member providing ease of movement of the tong.

9. An improved tong positioning device, comprising:

a) a base;

b) an intermediate member pivotally attached to the base;

c) a power source being an elongated extensible member attached to a lower end of the intermediate member;

d) a forward member attached to the upper end of the intermediate member;

e) a free end of the forward member secured to a tong, so that pivotal movement of the intermediate member imparted by the power source imparts movement of the tong between engaged and disengaged positions around tubular members; and f) wherein the forward member carries a pair of air cylinders which define a means for allowing the arm to impart smooth, non-jerky contact with and movement to the tong.

10. An improved tong positioning device, comprising:

a) a base;

b) an intermediate member pivotally attached to the base;

c) a power source being an elongated extensible member attached to a lower end of the intermediate member;

d) a forward member attached to the upper end of the intermediate member;

e) a free end of the forward member secured to a tong, so that pivotal movement of the intermediate member imparted by the power source imparts movement of the tong between engaged and disengaged positions around tubular members; and f) wherein the pivot points between the power means, intermediate member and forward member are variable to compensate for the vertical and horizontal movement of the tong during operation.

11. An improved tong positioning apparatus, comprising:

a) a base;

b) a power means;

c) an articulating means secured at a first end to the power means;

d) a second end of the articulating means attached to a tong to impart movement of the tong between engaged and disengaged positions around a tubular member when the power means articulates the articulating means; and e)the base having non-rotating and rotating portions and a motor drive that rotates the rotating portion relative to the non-rotating portion and wherein the rotating portion carries the articulating means; and f) wherein the articulating means includes a first arm pivotally attached to the base with a pivot and a second arm supported by the upper end of the first arm; and g) wherein the power means connects to the first arm at a position that places the pivot in between the second arm and the power means.

12. The improved tong positioning apparatus of claim 11, wherein the power means comprises a hydraulic cylinder, air cylinder or other power device.

13. An improved tong positioning apparatus, comprising:

a) a power means;

b) an articulating means secured at a first end to the power means;

c) a second end of the articulating means attached to a tong to impart movement of the tong between engaged and disengaged positions around a tubular member when the power means articulates the articulating means;

d) a base having non-rotating and rotating portions and a motor drive that rotates the rotating portion relative to the non-rotating portion and wherein the rotating portion carries the articulating means; and e) wherein the articulating means comprises a first moment arm pivotally secured to a second forward shock absorbing arm.

14. The apparatus in claim 13, wherein the forward shock absorbing arm further comprises at least one air or gas shock/cylinder for absorbing shock between the arm and the tong, so as to impart smooth movement of the tong as it contacts lengths of tubular members.

15. An improved tong positioning apparatus, comprising:

a) a base having a fixed and rotating parts and a motor drive that rotates the rotating part relative to the fixed part;

b) a plurality of columns defining a support that is anchored to the rotating part;

c) a first arm pivotally attached to the support with a pivotal connection;

d) a second arm attached to an upper end of the first arm;

e) a fluid operated extensible cylinder attached to one of the columns and to a lower end of the first arm below said pivotal connection;

f) a tong attached to the second arm, so that when the cylinder moves between retracted and expanded positions, the first and second arms articulate to move the tong between engaged and disengaged positions relative to tubular well drilling members.

16. The improved tong positioning apparatus of claim 15, further comprising a protective shield to protect the operator of the apparatus from moving parts of the apparatus.

17. An improved tong positioning apparatus, comprising:

a) a base having a fixed and rotating parts and a motor drive that rotates the rotating part relative to the fixed part;

b) a plurality of columns anchored to the rotating part;

c) a first arm attached to one of the columns;

d) a second arm attached to an upper end of the first arm;

e) a fluid operated extensible cylinder attached to one of the columns and to a lower end of the first arm;

f) a tong attached to the second arm, so that when the cylinder moves between retracted and expanded positions, the first and second arms articulate to move the tong between engaged and disengaged positions relative to tubular well drilling members; and g) wherein the connections between the cylinder and the first arm provide a plurality of connection points.

18. An improved tong positioning apparatus, comprising:

a) a base having a fixed and rotating parts and a motor drive that rotates the rotating part relative to the fixed part;

b) a plurality of columns anchored to the rotating part;

c) a first arm attached to one of the columns;

d) a second arm attached to an upper end of the first arm;

e) a fluid operated extensible cylinder attached to one of the columns and to a lower end of the first arm;

f) a tong attached to the second arm, so that when the cylinder moves between retracted and expanded positions. the first and second arms articulate to move the tong between engaged and disengaged positions relative to tubular well drilling members; and g) wherein the pivot points between the first arm and the base define a plurality of connection points.

19. An improved tong positioning apparatus, comprising:

a) a base having a fixed and rotating parts and a motor drive that rotates the rotating part relative to the fixed part;

b) a plurality of columns anchored to the rotating part;

c) a first arm attached to one of the columns;

d) a second arm attached to an upper end of the first arm;

e) a fluid operated extensible cylinder attached to one of the columns and to a lower end of the first arm;

f) a tong attached to the second arm, so that when the cylinder moves between retracted and expanded positions, the first and second arms articulate to move the tong between engaged and disengaged positions relative to tubular well drilling members; and g) wherein the connection between the first arm and the second arm define a plurality of connection points.

20. An improved tong positioning apparatus, comprising:

a) a base having a fixed and rotating parts and a motor drive that rotates the rotating part relative to the fixed part;

b) a plurality of columns anchored to the rotating part;

c) a first arm attached to one of the columns;

d) a second arm attached to an upper end of the first arm;

e) a fluid operated extensible cylinder attached to one of the columns and to a lower end of the first arm;

f) a tong attached to the second arm, so that when the cylinder moves between retracted and expanded positions, the first and second arms articulate to move the tong between engaged and disengaged positions relative to tubular well drilling members; and g) wherein the connection points between the cylinder and the base, and the first arm and the base and the first arm and the second arm define a means to allow a variation of the horizontal and vertical position of the device relative to the tong.

* * * * *